US011854348B2

(12) United States Patent
Filipour et al.

(10) Patent No.: US 11,854,348 B2
(45) Date of Patent: Dec. 26, 2023

(54) SYSTEM AND METHOD FOR LOTTERY AND SKILL GAMES

(71) Applicant: IGT, Las Vegas, NV (US)

(72) Inventors: Cameron Filipour, Las Vegas, NV (US); Dwayne Nelson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 423 days.

(21) Appl. No.: 16/690,792

(22) Filed: Nov. 21, 2019

(65) Prior Publication Data

US 2021/0158656 A1 May 27, 2021

(51) Int. Cl.
*G07F 17/32* (2006.01)

(52) U.S. Cl.
CPC ..... *G07F 17/3262* (2013.01); *G07F 17/329* (2013.01); *G07F 17/3225* (2013.01); *G07F 17/3258* (2013.01); *G07F 17/3295* (2013.01)

(58) Field of Classification Search
CPC ..... G07F 17/3262; G07F 17/3225; G07F 17/3258; G07F 17/329; G07F 17/3295
See application file for complete search history.

(56) References Cited

U.S. PATENT DOCUMENTS 6,149,522 A 11/2000 Alcorn et al.
6,588,747 B1 * 7/2003 Seelig ..... G07F 17/32 273/138.1
6,685,567 B2 2/2004 Cockerille et al.
6,804,763 B1 10/2004 Stockdale et al.
6,863,608 B1 3/2005 LeMay et al.
6,962,530 B2 11/2005 Jackson
7,043,641 B1 5/2006 Martinek et al.
7,111,141 B2 9/2006 Nelson
7,201,662 B2 4/2007 LeMay et al.
7,384,339 B2 6/2008 LeMay et al.
7,515,718 B2 4/2009 Nguyen et al.
8,147,334 B2 4/2012 Gatto et al.
8,627,097 B2 1/2014 Wolf
8,764,566 B2 7/2014 Miltenberger et al.
9,501,894 B2 11/2016 Hughes
9,652,934 B2 5/2017 Johnson
9,898,894 B2 * 2/2018 Chhabra ..... G07F 17/3251
10,173,126 B2 1/2019 Brouillard
(Continued)

OTHER PUBLICATIONS

Snide, Mike, "Candy Crush-Type Game for State Lotto Debuts", USA Today, Sep. 16, 2016, https://www.usatoday.com/story/tech/news/2016/09/16/new-app-mixes-lottery-puzzle games-cash/90462768.

(Continued)

*Primary Examiner* — James S. McClellan
*Assistant Examiner* — Ross A Williams
(74) *Attorney, Agent, or Firm* — SHERIDAN ROSS PC

(57) ABSTRACT

The present disclosure relates generally to a lottery gaming system and method that determine that a selected user is associated with a lottery game entry in a lottery game having a winning lottery amount, receive an input of the selected user from a secondary game different from the lottery game, and, in response to receiving the input, determine an outcome modifier that adjusts a user share of the winning lottery amount. The present disclosure further relates to a gaming device that interacts with the lottery gaming system.

20 Claims, 10 Drawing Sheets

(56) References Cited

U.S. PATENT DOCUMENTS

| | | | | |
|---|---|---|---|---|
| 10,282,936 | B2 | 5/2019 | Barnes | |
| 10,360,768 | B2 | 7/2019 | Saccoccio | |
| 10,366,570 | B2 | 7/2019 | Caputo | |
| 2005/0064930 | A1 | 3/2005 | Jubinville | |
| 2005/0064931 | A1 | 3/2005 | Lathrop | |
| 2007/0060285 | A1* | 3/2007 | White | A63F 3/06 463/18 |
| 2008/0132314 | A1 | 6/2008 | Robb | |
| 2012/0178514 | A1 | 7/2012 | Schulzke | |
| 2017/0046907 | A1* | 2/2017 | Kawai | G07F 17/3267 |
| 2018/0047253 | A1* | 2/2018 | Vann | G07F 17/3262 |
| 2019/0275414 | A1* | 9/2019 | Martineck, Sr. | G07F 17/3262 |

OTHER PUBLICATIONS

"Paymaxs website," paymaxs, 2015, 10 pages [retrieved online from: web.archive.org/web/20190731121616if/https://www.paymaxs.com/#about-about].

Snider "Candy Crush-type game for state lotto debuts," USA Today, Sep. 16, 2016, 2 pages [retrieved online from: www.usatoday.com/story/tech/news/2016/09/16/new-app-mixes-lottery-puzzle-games-cash/90462768/].

* cited by examiner

SYSTEM AND METHOD FOR LOTTERY AND SKILL GAMES

BACKGROUND

The present disclosure is directed toward a lottery game and, in particular, a modified lottery game that is improved by operation of secondary games.

A lottery is a form of gambling that involves the drawing of numbers at random for a prize. Lottery game entries, such as lottery tickets, allow players to play instant, online, or draw-based lottery games. Lottery drawings normally occur periodically and there is often a delay between a user receiving their lottery numbers and the winning lottery numbers being drawn.

BRIEF SUMMARY

In certain embodiments, the present disclosure relates to a lottery gaming system that can include a communications interface that enables communications with a gaming device of a selected user, a processor coupled to the communications interface, and a computer-readable storage memory coupled with the processor. The memory can include instructions that are executable by the processor, and the instructions in turn can include: a set of instructions that determines that the selected user is associated with a lottery game entry in a lottery game corresponding to a winning lottery amount; a set of instructions that receives an input of the selected user from a secondary game other than the lottery game; and a set of instructions that, in response to receipt of the input, determines an outcome modifier that adjusts an expected value of the selected user's lottery game entry. The expected value of a lottery game entry refers to the product of the probability that the lottery game entry will be associated with a winning lottery game outcome multiplied by the potential payoff to the user for the winning lottery game outcome. Accordingly, the outcome modifier can adjust either or both of the probability that the lottery game entry will be associated with a winning lottery game outcome and/or the potential payoff for the winning lottery game outcome (e.g., the user's share of the jackpot).

In some embodiments, the present disclosure also relates to a method that can include: determining that a selected user is associated with a lottery game entry in a lottery game corresponding to a winning lottery amount; receiving an input of the selected user from a secondary game different from the lottery game; and, in response to receiving the input, determining an outcome modifier that adjusts an expected value of the selected user's lottery game entry.

In some embodiments, the present disclosure also relates to a gaming device that can include a display, a communications interface that facilitates machine-to-machine communications via a communication network, a processor coupled to the display and the communications interface, and a computer memory coupled with the processor. The computer memory can include processor-executable instructions that, when executed by the processor, cause the processor to: provide to a lottery gaming system an entry in a lottery game associated with a winning lottery amount, the lottery game entry being associated with a selected user; render a secondary game different from the lottery game on the display; receive, via the secondary game rendered by the display, an input of the selected user; provide, via the communications interface, the input to the lottery gaming system; receive, via the communications interface, an outcome modifier from the lottery gaming system, the outcome modifier being related to the input and adjusting an expected value of the selected user's lottery game entry; and render the outcome modifier on the display.

Additional features and advantages are described herein and will be apparent from the following Description and the figures.

DETAILED DESCRIPTION

Figure 1:
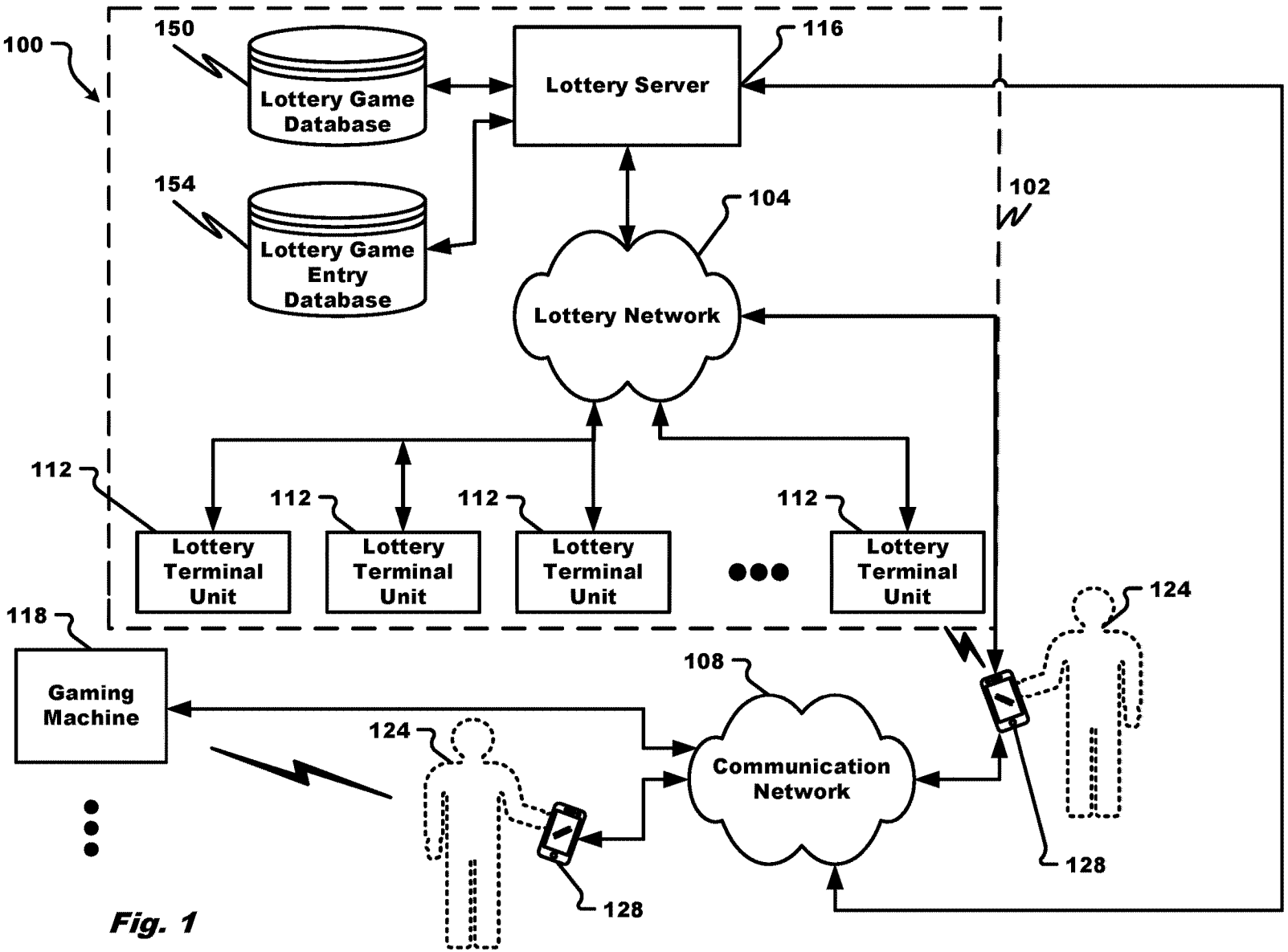
FIG. 1 illustrates a gaming system in accordance with embodiments of the present disclosure.

In some embodiments, one or more user secondary game inputs adjust an expected value of a user's lottery game entry, such as increasing or decreasing a probability of having a winning outcome in the lottery game or increasing or decreasing a winning user's share of a lottery jackpot in a primary lottery game or both. The jackpot is, in some implementations, a largest possible winning prize. Other possible winning prizes may include some or all of a Return to Player (RTP) amount for the lottery game, and the winning prize award is, in some implementations, a winning prize amount that may be redeemed by a winning lottery game entry. As an example, the user acquires a lottery game entry, such as a ticket purchased by the user and having a unique identifier (e.g., a Quick Response (QR) code), and is provided with one or more opportunities to play a secondary game that can determine one or more outcome modifiers to increase the user's share of the lottery jackpot if the user's lottery game entry were later determined (such as by a random drawing) to be a winning lottery result. The ability to obtain an outcome modifier can allow the user to feel some accomplishment from increasing the user's potential share of the jackpot, which makes the lottery more than just a random experience. Moreover, the secondary game input(s) that determine an outcome modifier can conveniently be obtained by the user's engagement with a secondary game provided by an application on the user's mobile or personal computing device. The secondary game input(s) can additionally or alternatively be obtained on other gaming devices, such as electronic gaming machines (EGMs), virtual gaming machines (VGMs), video game gambling machines, video lottery terminals, and electronic table games (ETGs).

In one non-limiting example, a lottery system is linked by a Wide Area Network (WAN) or Local Area Networked (LAN) with a gaming device associated with the user. Once the user is associated by the lottery system with an accepted lottery game entry, the lottery system causes the gaming device to present the user with one or more secondary games (e.g., games of knowledge, skill, random chance, pseudo skill or chance, or a combination thereof) to collect one or more user inputs. In one non-limiting illustration, the user can be presented with trivia questions in a challenge game with the number and/or type of correctly answered questions being the user input(s). In another non-limiting illustration, the user can alternatively or additionally be presented with a game of skill, such as fighting, shooting or puzzle games, with the user's point value(s) and/or accomplishment of certain events (e.g., passing or beating of a particular game proficiency level, destruction of a certain boss, etc.) being the user input(s). In yet another non-limiting illustration, the user can alternatively or additionally be presented with a freemium skill game with the user's point score or receipt of special awards or prize (such as game power-ups or digital merchandise), and/or other proficiency level measure being the user input(s). In yet another non-limiting illustration, the user can alternatively or additionally be presented with a game of chance, such as roulette, slots, or craps, with the winning or losing outcome or winnings being the chance-based user input(s). In yet a further non-limiting illustration, the user can alternatively or additionally be presented with a pseudo game of skill or chance, such as poker or blackjack, with the winning or losing outcome being the user input(s).

Depending on the implementation, the outcome modifier ("OM") can increase or decrease the user's share of the jackpot ("USJ") from a first USJ to a second USJ by a selected mathematical operation, such as addition (e.g., $US_{NEW}=USJ_{OLD}+OM$), multiplication (e.g., $USJ_{NEW}=OM\times USJ_{OLD}$) or subtraction (e.g., $USJ_{NEW}=USJ_{OLD}-OM$), to name a few. In one non-limiting example that assumes that the minimum top lottery winning prize amount is $10,000, the lottery system can determine one or more outcome modifiers from the user input(s) that can increase by addition the top prize by one or more higher levels (e.g., $20,000, $30,000, $40,000, etc.) to a predetermined RTP amount for the lottery game. In another non-limiting example that assumes that the minimum top lottery winning prize amount is $10,000, the lottery system can determine one or more outcome modifiers from the user input(s) that can each increase by multiplication the top prize by 50% (e.g., $15,000, $22,500, $33,750, etc.) to a predetermined RTP amount for the lottery game. In another non-limiting example that assumes that there are multiple winning lottery game entries and that the minimum top lottery winning prize amount is $30,000, the lottery system can determine one or more outcome modifiers from the user input(s) that can each increase by addition or decrease by subtraction the top prize by $5,000 to realize for all winning lottery game entries a predetermined RTP amount for the lottery game. As will be appreciated, numerous other mathematical techniques used in determining winnings or awards in gaming can be employed.

Any number of ways can be used to determine when and how to adjust the winning prize amount. As a non-limiting example, the winning prize amount could be adjusted for the top users or scaled by how well the user performs compared to the other users of the secondary game, with the best user (or user having the highest rated user input(s)) receiving a larger increment or outcome modifier and the worst user (or user having the worst rated user input(s)) receiving the smallest or no outcome modifier. In other words, the best user (or user having the highest rated user input(s)) receives a larger increment or outcome modifier and the worst user (or user having the worst rated user input(s)) receives the smallest or no outcome modifier. To amplify the competition, the input(s) or secondary game results of the other user(s) can be published (such as by a leader board) to each of the competing user(s). The competitive grading of the inputs of the various users can be done, for instance, using a normal distribution and assigning outcome modifiers based on the position of the inputs of the various users on the curve, by mapping the user input(s) of each user into predetermined ranges of user input(s) values, and the like. As will be appreciated, numerous other mathematical techniques used in comparing results across multiple users or events can be employed.

In some embodiments, messages of encouragement and/or tips or recommendations on secondary game play can be sent to a user. In a non-limiting example, the user can be encouraged to play a further secondary game as his performance is improving when compared to prior secondary game plays by the same user. The prior secondary game play input(s) by the user are stored in the lottery game entry database 154 as discussed further below. By way of further non-limiting example, the user can be given tips or recommendations on how he or she can have improved performance during a current or future secondary game play. This can be done by an intelligent application monitoring the game play of the current user and/or other users, noting user behaviors that produce higher secondary game play proficiency levels of the monitored user(s), and notifying the user behaviors to the current user. Alternatively or additionally, the secondary game instructions can include embedded tips to provide to a user in the event the user's play requires improvement.

In some embodiments, the users can cooperatively and collaboratively work in a user group to receive a common outcome modifier to increase equally a potential win amount of each of the users in the group. The user group can compete against one or more other user groups with the winning prize amount being adjusted only for the top user group or scaled by how well the user group performs compared to the other user groups in the secondary game. In other words, the best user group (or user group having the highest rated user input(s)) receives a larger increment or outcome modifier and the worst user group (or user group having the worst rated user input(s)) receives the smallest or no outcome modifier. The input(s) used for each group can be a highest input(s) realized by any user member in each group, an average, mean, or median of the input(s) received from the various user members of each group, and other methods appreciated by one of ordinary skill in the art. To amplify the competition, the input(s) or secondary game results of the other group(s) can be published (such as by a leader board) to each of the competing group(s). The competitive grading of the inputs of the various user groups can be done, for instance, using a normal distribution and assigning outcome modifiers based on the position of the inputs of the various user groups on the curve, by mapping the user input(s) of each user group into predetermined ranges of user input(s) values, and the like. As will be appreciated, numerous other mathematical techniques used in comparing results across multiple users or events can be employed. In any of the user group examples, the outcome modifier can be used to increment only a winning prize amount for only one user group member having a lottery game entry corresponding to a winning result or to increment a winning prize amount to be shared by the group if a group member or the group itself has a lottery game entry corresponding to a winning result. In this case, the user group members could share the incremented winning prize amount.

In some embodiments, the secondary game can adjust one or more winning prize amounts. In one non-limiting example, the lottery game can have a primary level corresponding to a first winning prize amount and a secondary level corresponding to a different second prize winning amount. The outcome modifier can increment one or both of the prize winning amounts. By way of non-limiting illustration, some secondary games presented to the user can increment the first prize winning amount while another secondary game presented to the user can increment the second prize winning amount. As will be appreciated, the lottery game can have more than two prize winning levels.

In some embodiments, the lottery gaming system can push promotional notifications or advertisements to users or potential users notifying them of outcome modifier availability upon certain terms or conditions. By way of non-limiting example, users or potential users can be notified that the first X number of users to buy lottery game entries will receive an outcome modifier or higher level of outcome modifier. After the X number of users buy lottery game entries, the outcome modifier or higher level of outcome modifier will no longer be available. By way of further non-limiting example, users or potential users can be notified that users buying lottery game entries within a defined time window will receive an outcome modifier or higher level of outcome modifier. After expiration of the time window, the outcome modifier or higher level of outcome modifier will no longer be available. Other promotional terms and conditions will be appreciated to one of ordinary skill in the art.

In some embodiments, the user can play the secondary game at least a predetermined number of times to improve his or her outcome modifier. Each time a secondary game is played, the user can be required to pay an additional "replay" amount. Where a limit is imposed on the number of replays permitted, a count-down or count-up lottery modifier counter can be used. In other words, the lottery modifier counter can have a minimum (count-down counter configuration) or maximum (count-up counter configuration) counter value.

In some embodiments, the user can buy multiple lottery game entries and move user input(s) or outcome modifiers received from playing a secondary game associated with a first lottery game entry to a different second lottery game entry of the user. This permits a user to move higher user input(s) or outcome modifiers from a "less lucky" lottery game entry to a "luckier" lottery game entry.

In some embodiments, the user can buy multiple lottery game entries and associate user input(s) or outcome modifiers received from playing a secondary game associated with a first lottery game entry to a set of lottery game entries of the user. Stated differently, the user can pool or group lottery game entries together and share a common higher outcome modifier amongst the various lottery game entries in the pool or group. This encourages a user to buy multiple lottery game entries so that he or she can receive a higher outcome modifier to be shared amongst all of the multiple lottery game entries.

In any of the embodiments in which a first set of user input(s) can be moved from a first lottery game entry to a second lottery game entry or shared with the second lottery game entry, the association with the different second lottery game entry can occur before, during, or after play of the secondary game associated with the first set of user input(s).

In some embodiments, the user can purchase or earn a user level in the lottery game that is an additional factor in determining an outcome modifier from the user input(s). Stated differently, a common set of user inputs can produce different outcome modifiers for different user levels in the lottery game. The user level can be related to or based on user proficiency at play of the secondary game, user lottery game entry purchase history, user payment towards the user level, and other loyalty or customer-based indicia.

In some embodiments, the user can purchase or earn a user level in the lottery game with the user level determining a number of secondary games that can be played to provide input(s) for the outcome modifier calculation. Stated differently, a first user level enables a selected user to play X secondary games to provide a first set of outcome modifier input(s), and a second user level enables the selected user to play Y secondary games to provide a second set of outcome modifier input(s). The number of input(s) in the first set is different from the number of input(s) in the second set. If the user started at the lower, second level and, after playing Y secondary games, decided to move to the higher, first level, the user could be given an entirely new set of X secondary games to play or the difference between X and Y secondary games.

As will be appreciated, the ability of users in a lottery game to play secondary games to improve or increase the user's share of the jackpot can increase the level of user interaction or involvement in the lottery game, thereby increasing a level of user satisfaction and excitement, and can increase revenue realized from the lottery game without significant additional cost. The secondary game typically can enable an award to be obtained in addition to any award obtained through play of the lottery game(s). The secondary game(s) typically produces a higher level of player excitement than the lottery game(s) because the secondary game(s) can provide a greater expectation of winning than the lottery game(s) and can be accompanied with more attractive or unusual features than the lottery game(s). The secondary game(s) may be any type of suitable game, either similar to or completely different from the lottery game.

There are any number of ways to implement the application of the outcome modifier to the winning prize amount to yield the user share of the jackpot.

In a non-limiting example if the user input were the result of a secondary game of chance, such as flipping a coin or drawing a red or black card from a deck, slots, die rolling, roulette, etc., a mathematical solution can be employed. For instance if a lottery game had 4 user input points and each one had a 50% chance of success and the operator wanted an average top award of $30,000, the lottery game could start each user at a $10,000 minimum top award and increase that award by $10,000 at every successful input from the secondary game. In this non-limiting illustration, final top award outcomes could be $10,000; $20,000; $30,000; $40,000; or $50,000 but the desired top award of $30,000 could be achieved in a dependable, predictable manner. As will be appreciated, other mathematical solutions known to those of skill in the art can be employed.

In a non-limiting example for dynamic award outcomes in which user skill or a combination of skill and chance are involved, a different solution can be employed. In one illustrative solution if the minimum top award were $10,000, the desired top user's share of the jackpot were $30,000, and there were 4 skill input points such as answering trivia questions, the user may again be granted 4 inputs, with each successful input (i.e. each successfully answered trivia question) raising the top award by $5,000. In another illustrative solution, if the minimum top award were $20,000, the desired top user's share of the jackpot were $50,000, and there were 3 skill proficiency levels in the secondary game of skill or hybrid secondary game of skill and chance, the user would again be granted 3 user inputs, with each successful input (i.e. each successfully accomplished proficiency level) raising the top award by $10,000. In yet another illustrative solution, if the minimum top award were $10,000, the desired top user's share of the jackpot were $40,000, and there were 4 game score ranges in the secondary game of skill or hybrid secondary game of skill and chance (e.g., 0-5,000 points (no user input), 5,001-10,000 points (first user input), 10,001-15,000 points (second user input), and 15,001-20,000 points (third user input)), the user would again be granted 3 user inputs (first, second, and third user inputs), with each successfully accomplished user input (i.e. each successfully accomplished score within the corresponding scoring range) raising the top award by $10,000.

In some embodiments when the winning prize amount is less than the predetermined RTP amount due to imperfect play, the difference can be awarded to the winning user(s) through further outcome modifier(s) incrementing the winning prize amount(s) of the winning lottery game entries. This can be done by any suitable technique, such as by applying a common outcome modifier on a pro-rata basis, by applying different outcome modifiers to different users based on a selected pre-drawing set of user input(s) or outcome modifier for each user (such as by generating a new set of outcome modifiers based on comparing the various different outcome modifiers of the winning lottery game entries, with the winning lottery game entry having the highest outcome modifier receiving a highest new outcome modifier and the winning lottery game entry having the lowest outcome modifier receiving a lowest new outcome modifier), and the like.

In some embodiments, a secondary award pool can be used to account for the consequences of imperfect play. In one non-limiting example assuming perfect play and that a top desired user's share of the jackpot was $30,000, some users, through imperfect play, may achieve a lower top award than the desired $30,000 user's share of the jackpot. Achieving a predictable RTP within the lottery game can be achieved by storing winnings not won through imperfect skill in a separate secondary award pool and awarding them back to users having winning lottery outcomes via other mechanisms. For example, any time a user wins the top award and that award is less than $30,000, the delta or difference between $30,000 and the incremented winning prize amount would be captured and added to Award Pool A. Separate criteria can be specified for winning the funds in Award Pool A, such as specified requirements for a second set of user inputs from a further secondary game of knowledge, skill, random chance, pseudo skill or chance, or a combination thereof. For instance, the secondary game can be a purely random event that occurs after each ticket is graded, a hybrid chance and skill-based event such as answering all questions correctly for a random chance to win Award Pool A, or a purely skill-based event such as answering 10 consecutive questions correctly.

In some embodiments, a lottery game can have multiple winning lottery game entries, with each lottery game entry being entitled to receive a first share of the jackpot. Additional shares of the jackpot can be awarded based on user input(s) received through competitive game play between the users or groups of users associated with the winning lottery game entries. Output modifiers are determined for the various users or user groups based on their comparative user input(s) (e.g., secondary game outcomes), with the outcome modifiers being applied to the balance of the jackpot to determine user or user group shares of the jackpot.

In some embodiments, a lottery game can have multiple winning lottery game entries, with each lottery game entry's sharing in the jackpot being dependent upon secondary game play. Shares of the jackpot can be awarded based on user input(s) received through competitive game play between the users or groups of users associated with the winning lottery game entries. Output modifiers are determined for the various users or user groups based on their comparative user input(s) (e.g., secondary game outcomes), with the outcome modifiers being applied to the jackpot to determine user or user group shares of the jackpot.

In some embodiments, to qualify for a share of the jackpot the user having a lottery game entry must play the secondary game after purchasing the lottery game entry. The user's share of the jackpot is then based on the proficiency level of the user in secondary game play.

In some embodiments, the outcome modifier adjusts a likelihood of a user having a winning lottery outcome, or (as in other embodiments) the user's expectation or expected value associated with a lottery game entry. By way of non-limiting example, a user is allocated X sets of lottery numbers upon making a purchase and then, after playing a secondary game, may end up adding (or possibly losing) sets of lottery numbers based on the outcome of that secondary game. For instance, a $1 purchase by a user may buy lottery number sets A, B, and C. Then, the user answers trivia questions and based on a strong performance may earn additional lottery number sets like D and E. In one variation, the user could also some or all of the lottery number sets A, B, or C with a poor performance. After the secondary game, if any of the user's active lottery number sets match the drawn winning lottery numbers, then he or she is a winner and is entitled to share in the jackpot.

While specific embodiments are discussed, it is to be understood that the embodiments are intended to illustrate the principles of this disclosure and are not to be construed in any way as limiting the scope of this disclosure.

In any of the above embodiments, at an instance of a lottery drawing when a jackpot is won a similar win protocol to known lottery games can be applied. For example, all users wherever located can see a celebration on a display of a gaming device. In some embodiments, an advertisement may be presented of where the win occurred geographically or the winning user's outcome modifiers or game input(s) to contribute to the fun surrounding the winning of a large prize.

It should be appreciated that the lottery game may be administered, hosted, managed, or provided by a first entity whereas the secondary game (e.g., a game of chance, game of skill, or hybrid game of chance/skill) may be administered, hosted, managed, or provided by a second entity that is different from the first entity. The first entity may correspond to a public or private entity and the second entity may correspond to a public or private entity. For instance, the lottery game may be hosted by a first private entity (e.g., a charitable organization) whereas the secondary game may be hosted by a second private entity (e.g., a casino operator). As another example, the lottery game may be hosted by a public entity (e.g., a state-run entity, a governmental entity, etc.) and the secondary game may be hosted by a private entity (e.g., a casino operator). As another example, the lottery game may be hosted by a public entity (e.g., a state-run charitable organization) and the secondary game may be hosted by a different public entity (e.g., a state-run entity, a governmental entity, etc.). In some embodiments, there may be coordination between the first entity and the second entity even though both entities independently manage the lottery game and secondary game, respectively, meaning that rules to each of the lottery game and secondary game are determined by the independent entities, but rules for transitioning from the lottery game to the secondary game (e.g., what inputs for the lottery game can be received from the secondary game) may be mutually agreed upon by the independent entities.

Users can hold onto physical tickets or have the tickets transferred to their mobile wallet on their portable gaming device or user account where they are securely stored until the drawing occurs. When the drawing occurs, the lottery server will know if a winning ticket was distributed and, if the winning ticket was distributed electronically, then the user associated with the winning ticket may be notified of their lottery win and informed that they need to collect their prize.

In some embodiments, the lottery game may include a set of instructions that generate an electronic lottery ticket with at least the number assigned thereto as well as a set of instructions that assign the electronic lottery ticket to the user by storing an identification of the user in memory with an association to an identifier of the electronic lottery ticket. It may also be possible to cause a physical lottery ticket to be issued to the user by printing a physical ticket with the identifier thereon.

In some embodiments, the secondary game may include a game of chance, and the number or numbers and/or symbol or symbols generated as input(s) from the secondary game may be generated with a random number generator.

In some embodiments, a portable gaming device may be configured to execute one, some, or all of the secondary games described herein. The portable gaming device may be provided with a set of instructions that enable communications with a gaming machine for purposes of participating in the secondary game and a set of instructions that enable communications with a lottery server for purposes of participating in the lottery game.

In some embodiments, the portable gaming device or a gaming device may be provided with a set of instructions that determine the outcome modifier from the user input(s) received from the secondary game.

It should be appreciated that the award for the user may include a non-monetary award and/or a monetary award.

In some embodiments, the portable gaming device may be provided with a set of instructions that pair the portable gaming device with a gaming device for purposes of enabling the user to participate in the secondary game, where the portable gaming device is paired with the gaming device using a proximity-based communication protocol.

In some embodiments, the features of this disclosure are applied to other promotional schemes as the primary game, such as a sweepstake (which does not require consideration to be paid for the game entry) and a contest (which may require consideration to be paid for the game entry but eliminates chance in determining the winning result of the game).

The various embodiments described above can help to build the hysteria that can surround a lottery drawing, especially where the winning prize amount has grown significantly, while also enabling users to enjoy the immediate satisfaction of playing and possibly winning a secondary game. These and other features will be described in further detail herein.

With reference initially to FIG. 1, details of an illustrative gaming system 100 will be described in accordance with at least some embodiments of the present disclosure. The components of the gaming system 100, while depicted as having particular instructions (e.g., program code) and devices, is not necessarily limited to the examples depicted herein. Rather, a system according to embodiments of the present disclosure may include one, some, or all of the components depicted in the system 100 and does not necessarily have to include all of the components in a single device. For instance, the components of a lottery server 116 may be distributed among a plurality of servers, where one or more of the servers enable management of a lottery game and one or more other servers manage and execute a secondary game. The illustration of a single lottery server 116 is for ease of discussion and should not be construed as limiting embodiments of the present disclosure to a single-server architecture.

The gaming system 100 is shown to include a communication network 108 and a lottery gaming system 102, which in turn can comprise a lottery network 104, lottery server 116, lottery terminal units 112, and lottery game and lottery game entry databases 150 and 154.

The communication network 108 may correspond to a distributed set of devices that interconnect and facilitate machine-to-machine communications between the lottery server 116 and portable gaming devices 128 carried by users 124 and/or gaming machines 118. The lottery network 104 may correspond to a distributed set of devices that interconnect and facilitate machine-to-machine communications between one or multiple lottery terminal units 112 and the lottery server 116. In some embodiments, the lottery network 104 and communication network 108 may correspond to different networks administered and/or maintained by different entities. In such a scenario, one or more of a gateway, firewall, or similar network border device may reside between the lottery network 104 and the communication network 108 (e.g., to maintain security preferences/settings of each network). In another possible scenario, the lottery network 104 and communication network 108 may correspond to the same or similar network. As a non-limiting example of the second scenario, the lottery network 104 and communication network 108 may both correspond to a distributed Internet Protocol (IP)-based communication network, such as the Internet.

A lottery network 104 and communication network 108 may include any type of known communication medium or collection of communication media and may use any type of protocols to transport messages between devices. As some non-limiting examples, the lottery network 104 may correspond to a WAN or LAN in which the plurality of lottery terminal units 112 are configured to communicate with the lottery server 116 using devices that are owned and administered by the same entity that administers security settings of the lottery terminal units 112. As such, the lottery network 104 may be considered a secure or trusted network.

The communication network 108, in some embodiments, may also include a WAN or LAN. Alternatively or additionally, the communication network 108 may include one or more devices that are not administered by the same entity administering the lottery terminal units 112. Thus, the communication network 108 may be considered an untrusted or unsecure network from the perspective of the lottery network 104. The Internet is an example of the communication network 104 that constitutes an IP network consisting of many computers, computing networks, and other communication devices located all over the world, which are connected through many telephone systems and other means. Other examples of the communication network 104 include, without limitation, a standard Plain Old Telephone System (POTS), an Integrated Services Digital Network (ISDN), the Public Switched Telephone Network (PSTN), a cellular network, and any other type of packet-switched or circuit-switched network known in the art. In some embodiments, the communication network 108 may be administered by a Mobile Network Operator (MNO) whereas a lottery entity may administer the lottery network 104.

It should be appreciated that the lottery network 104 and/or communication network 108 need not be limited to any one network type, and instead may be comprised of a number of different networks and/or network types. Moreover, the lottery network 104 and/or communication network 108 may comprise a number of different communication media such as coaxial cable, copper cable/wire, fiber-optic cable, antennas for transmitting/receiving wireless messages, wireless access points, routers, and combinations thereof.

In some embodiments, the lottery terminal units 112 may be distributed throughout a single property or premises or the lottery terminal units 112 may be distributed among a plurality of different properties. In a situation where the lottery terminal units 112 are distributed in a single property or premises, the lottery network 104 may include at least some wired connections between network nodes (e.g., a LAN or multiple LANs). As a non-limiting example, the nodes of the gaming network 104 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

The lottery terminal units 112 may utilize the same or different types of communication protocols to connect with the lottery network 104.

In some embodiments, the gaming machines 118 may be configured to communicate with the lottery server 116. The lottery server 116 may be configured to centrally manage games of chance, games of skill, or hybrid games of chance/skill played at the gaming machines 118 (e.g., slot games), enable execution of a different game (e.g., a lottery game), monitor user 124 activity at the gaming machines 118, track user 124 association with a gaming machine 118 (e.g., an electronic gaming machine, virtual gaming machine, video game gambling machine, and electronic table game (ETG)), facilitate communications with users 124 via the gaming machines 118, facilitate communications with users 124 via the portable gaming devices 128 (or other gaming devices), and/or perform any other task in connection with games played by a user 124 at gaming devices.

The gaming machines 118 may utilize the same or different types of communication protocols to connect with the communication network 108. It should also be appreciated that the gaming machines 118 may or may not present the same type of secondary game to a user 124. For instance, the first gaming machine 118 may correspond to a gaming machine that presents a slot game to the user 124 whereas a second gaming machine 118 may correspond to a gaming machine that presents a different type of slot game or a video poker game to a user 124. It should be appreciated that a gaming machine 118 may correspond to one example of a gaming device. It should also be appreciated that the functions and features described in connection with a gaming machine 118 may be provided in any other type of gaming device without departing from the scope of the present disclosure.

In some embodiments, the gaming machines 118 may be distributed throughout a single property or premises (e.g., a single casino floor) or the gaming machines 118 may be distributed among a plurality of different properties. In a situation where the gaming machines 118 are distributed in a single property or premises, the communication network 108 may include at least some wired connections between network nodes (e.g., a LAN or multiple LANs). As a non-limiting example, the nodes of the communication network 108 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

In some embodiments, a user 124 may be enabled to enhance their experience with the gaming machines 118 via interactions with portable gaming device 128, such as a user's portable gaming device or other portable communication device. In some embodiments, a portable gaming device 128 may be configured to execute one or more games of chance, one or more games of skill, and/or one or more hybrid games of chance/skill that are also executable by a gaming machine 118. In some embodiments, the portable gaming device 128 may be referred to as a personal gaming device that is configured to be owned and carried by a user 124. For instance, a user 124 may be allowed to purchase a lottery game entry at their portable gaming device 128, play a secondary game at their portable gaming device 128, or engage with both the lottery server and secondary game at their portable gaming device 128 without ever having to physically engage a gaming machine 118. The portable gaming device 128 may correspond to a mobile communication device, such as a smartphone, tablet, laptop, PDA, wearable device, an augmented reality headset, a virtual reality headset, or the like. In other embodiments, the portable gaming device 128 may correspond to a PC, kiosk, or the like that facilitates improved secondary game play for the user 124. Any of the above-mentioned examples of a portable gaming device 128 may correspond to an example of a gaming device as described herein.

In some embodiments, a portable gaming device 128 may be configured to communicate directly with a lottery terminal unit 112 or gaming machine 118. In some embodiments, some or all of the secondary game play may be achieved with the portable gaming device 128 rather than relying on the use of a lottery terminal unit 112 or gaming machine 118. Where a portable gaming device 128 interacts with a lottery terminal unit 112 or gaming machine 118, direct machine-to-machine communications may utilize a proximity-based communication protocol such as NFC, Bluetooth®, BLE, WiFi, or the like. Alternatively or additionally, the portable gaming devices 128 may be configured to communicate with other portable gaming devices 128 and/or the lottery server 116 via the communication network 108. Such communications may be secured (e.g., encrypted) or unsecured depending upon the nature of information exchanged during the communications. A portable gaming device 128 may correspond to a user's 124 personal device that uses an unsecured or untrusted communication network 108 or to a device issued to the user 124 during the user's visit at a particular casino, in which case the portable gaming device 128 may be administered with certain casino-approved security policies.

It should be appreciated that the lottery server 116 may or may not be co-located with the lottery terminal units 112. Further still, users 124 may be allowed to carry multiple portable gaming devices 128, which may or may not be required to communicate or pair with a lottery terminal unit 112 or gaming machine 118.

FIG. 1 also depicts the possibility of some portable gaming devices 128 being paired with a lottery terminal unit 112 or gaming machine 118, thereby enabling communications to flow between the portable gaming device 128 and lottery terminal unit 112 or gaming machine 118. This communication may utilize a proximity-based communication protocol, such as Bluetooth, BLE, NFC, WiFi, etc. FIG. 1 further shows that one or more portable gaming devices 128 may not necessarily be paired with a lottery terminal unit 112 or gaming machine 118, but such portable gaming devices 128 may still be configured to communicate with the lottery server 116 via the communication network 108. Communications between the lottery terminal unit 112 or gaming machine 118 and portable gaming device 128 may facilitate any number of combinations of gameplay opportunities. For instance, a user 124 may play a first secondary game on a gaming machine 118, a second secondary game on a lottery terminal unit 112, and a third secondary game on their portable gaming device 128. As another example, a user 124 may play a first secondary game on their portable gaming device 128 and then play a second secondary game on the lottery terminal unit 112 or gaming machine 118. In another example, the user 124 may play multiple secondary games on the portable gaming device 128 and none on the lottery terminal unit 112 or gaming machine 118.

FIG. 1 also depicts the lottery server 116 being in communication with a lottery game database 150 storing general information related to the lottery game and a lottery game entry database 154 storing specific information related to accepted lottery game entries and related users 124. The lottery game and lottery game entry databases 150 and 154 are discussed in detail in FIGS. 5A and 5B, respectively.

Figure 2:
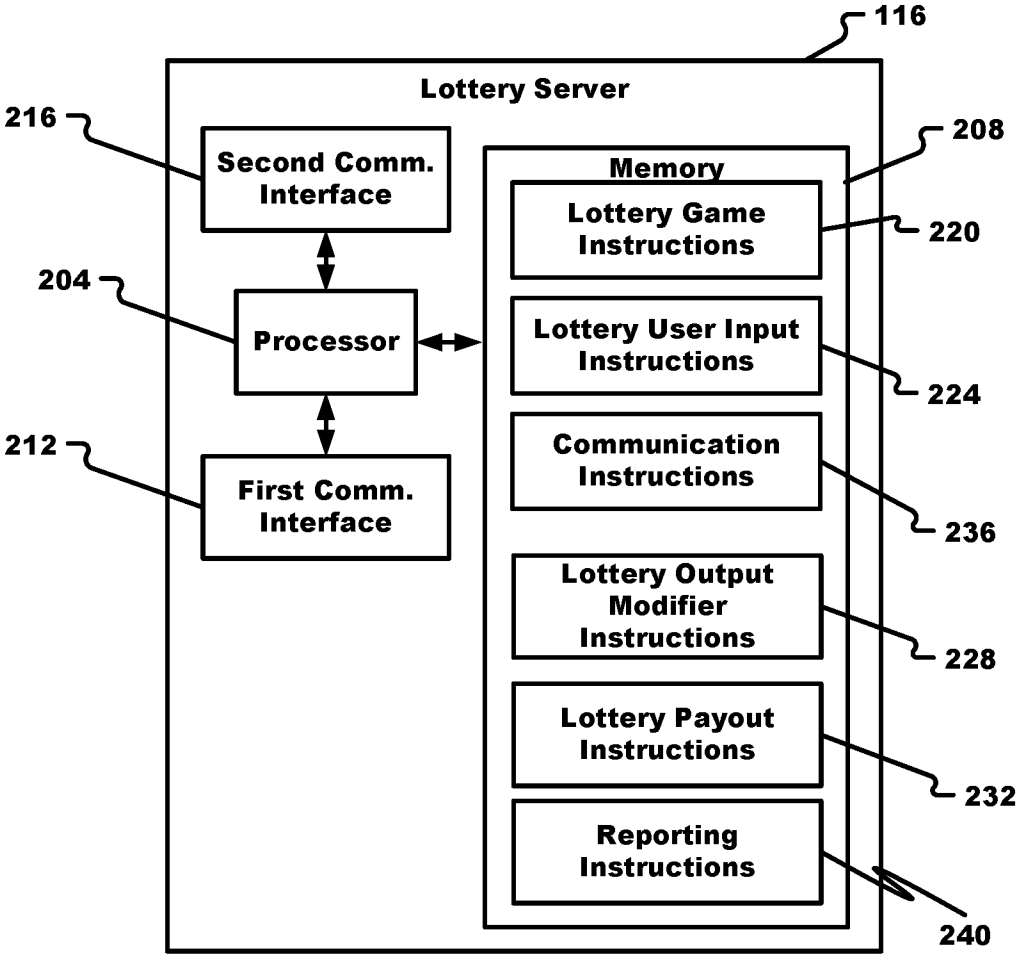
FIG. 2 illustrates a lottery server in accordance with embodiments of the present disclosure.

With reference now to FIG. 2, additional details of a lottery server 116 will be described in accordance with embodiments of the present disclosure. The lottery server 116 is shown to include a processor 204, memory 208, and first and second communication interfaces 212, 216. These resources may enable functionality of the lottery server 116 as will be described herein. For instance, the first communication interface 212 may provide the lottery server 116 with the ability to send and receive communication packets or the like over the lottery network 104. The first communication interface 212 may be provided as a network interface card (NIC), a network port, drivers for the same, and the like. Communications between the components of the lottery server 116 and other devices connected to the lottery network 104 may all flow through the first communication interface 212.

The lottery server 116 is also shown to include a second communication interface 216 that facilitates communications with the portable gaming devices 128 or gaming machines 118 via the communication network 108. In some embodiments, the second communication interface 216 may be similar to the first communication interface 212. For instance, the second communication interface 216 may also include a NIC, network port, drivers for the same, and the like. In some embodiments, the first and second communication interfaces 212, 216 may be provided in a single physical component or set of components, but may correspond to different communication channels (e.g., software-defined channels, frequency-defined channels, amplitude-defined channels, etc.) that are used to send/receive different communications to the portable gaming devices 128 or gaming machines 118 as compared to the lottery terminal units 112. In some embodiments, a single communication interface may facilitate communications with both the gaming machines 118, portable gaming devices 128, and lottery terminal units 112 especially if the devices communicate with the lottery server 116 via a common network.

The processor 204 may be similar or identical to the processor 204 and may correspond to one or many computer processing devices. For instance, the processor 204 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 204 may be provided as a microcontroller, microprocessor, Central Processing Unit (CPU), or plurality of microprocessors that are configured to execute the instructions sets stored in memory 208. Upon executing the instructions stored in memory 208, the processor 204 enables various authentication functions of the lottery server 116.

The memory 208 may be similar or identical to memory 208 and may include any type of computer memory device or collection of computer memory devices. The memory 208 may include volatile and/or non-volatile memory devices. Non-limiting examples of memory 208 include Random Access Memory (RAM), Read Only Memory (ROM), flash memory, Electronically-Erasable Programmable ROM (EEPROM), Dynamic RAM (DRAM), etc. The memory 208 may be configured to store the instructions depicted in addition to temporarily storing data for the processor 204 to execute various types of routines or functions.

The illustrative instructions that may be stored in memory 208 include, without limitation, the lottery game instructions 220, the lottery user input instructions 224, the lottery outcome modifier instructions 228, and lottery payout instructions 232. Functions of the lottery server 116 enabled by these various instructions are described below. Although not depicted, the memory 208 may include instructions that enable the processor 204 to store data into a lottery game database 150 and/or lottery game entry database 154 and retrieve information from the databases. Alternatively or additionally, the lottery game database 150 and/or lottery game entry database 154 or data stored therein may be stored internal to the lottery server 116 (e.g., within the memory 208 of the lottery server 116 rather than in a separate database).

It should be appreciated that the instructions depicted in FIG. 2 may be combined (partially or completely) with other instructions or may be further separated into additional and different instructions, depending upon configuration preferences for the lottery server 116, portable gaming device 128, gaming machine 118, and lottery terminal units 112. Said another way, the particular instructions depicted in FIG. 2 should not be construed as limiting embodiments described herein.

In some embodiments, the lottery game instructions 220, when executed by the processor 204, may enable the lottery server 116 to sell and provide to users lottery game entries, such as scratch-off tickets and computer generated digital tickets. In some embodiments, the lottery game instructions 220 may include subroutines that accept physical and digital lottery game entries from users, subroutines that determine a winning result for the lottery game, subroutines that compare the accepted user lottery game entry against the winning result to determine that the accepted user lottery game entry corresponds to the winning result and subroutines that present one or more graphics to the user via the user interface 316 of the lottery terminal unit 112 in connection with the foregoing operations. In some embodiments, the lottery game instructions 220 may also be configured to assign lottery numbers to a user 124, determine when a user 124 is eligible to redeem or try to earn a lottery number at the lottery terminal unit 112, and update electronic records reflecting lottery numbers assigned to a user 124, receive lottery numbers assigned to a user 124 from the lottery terminal unit 112, and perform any other function useful to administer a lottery game with the lottery terminal unit 112.

In some embodiments, the lottery user input instructions set 224, when executed by the processor 204, may enable the lottery server 116 to facilitate one or more secondary games of chance or skill or hybrid games of chance and skill to collect user input(s) for use in determining outcome modifier(s). In some embodiments, the lottery user input instructions 220 may include subroutines that present one or more graphics to the user via the user interface 216 in connection with user play of the secondary game, subroutines to collect user input(s) from user play of the secondary game, render a secondary game by presenting one or more graphics to the user via the user interface of the lottery terminal unit 112, and subroutines that manage a lottery modifier counter to determine whether the user is eligible to play the secondary game. In some embodiments, the lottery user input instructions 224 may also be configured to update electronic records reflecting user input(s) associated with a user 124 and perform any other function useful to administer a secondary game with the lottery terminal unit 112, gaming machine 118, or portable gaming device 128.

In some embodiments, the lottery outcome modifier instructions set 228, when executed by the processor 204, may enable the lottery server 116 to determine, from received user input(s), an outcome modifier to be applied to a winning user's share of the lottery jackpot. In some embodiments, the lottery outcome modifier instructions 228 may include subroutines that receive one or more inputs of a user, subroutines that, in response to receipt of the input(s), determine an outcome modifier that increments a user share of the winning lottery amount, and subroutines that select an outcome modifier from among multiple outcome modifiers determined from multiple input(s) associated with the user, such as input(s) from multiple secondary game plays by the user or by multiple users in a common group of users. In some embodiments, the lottery outcome modifier instructions 228 may also be configured to update electronic records reflecting outcome modifiers associated with a user 124.

In some embodiments, the lottery payout instructions 232, when executed by the processor 204, may enable the lottery server 116 to determine lottery game payouts to one or more users. In some embodiments, the lottery payout instructions 232 may include subroutines that, in response to determining that the accepted user lottery game entry corresponds to the winning result, applies the outcome modifier to the winning lottery amount to determine the user share of the jackpot and subroutines that compare the user share of the jackpot against a Return to Player (RTP) amount for the lottery game, determine a difference between the Player of the jackpot and the RTP amount, and, when the user share of the jackpot is less than the RTP amount, update an electronic record associated with a separate secondary award pool to reflect the difference, and subroutines that further distribute the separate secondary award pool among one or more users associated with different lottery game entries in the lottery game. In some embodiments, the lottery payout input instructions 232 may also be configured to update electronic records reflecting user payouts and secondary award pool management and perform any other function useful to administer lottery game payouts or awards.

The communication instructions 228, when executed by the processor 204, may enable the lottery server 116 to communicate with the other devices in the system 100. For instance, the communication instructions 228 may be configured to modulate/demodulate communications exchanged over the lottery network 104 and/or communication network 108, determine timings associated with such communications, determine addresses associated with such communications, etc. In some embodiments, the communication instructions 228 may be configured to allocate communication ports of the lottery server 116 for use as either the first or second communication interface 212, 216 as appropriate. The communication instructions 228 may further be configured to generate messages in accordance with communication protocols used by the networks 104, 108 and to parse messages received via the networks 104, 108.

The reporting instructions 240, when executed by the processor 204, may enable the lottery server 116 to generate and send reports to other communication devices (e.g., lottery terminal unit 112, gaming machines 118, portable gaming devices 128, other servers, etc.). The reports generated by the reporting instructions 236 may include information describing outcomes of lottery and/or secondary games associated with a particular user 124, outcomes associated with a group of users 124, etc. In some embodiments, the reporting instructions 236 may also be configured to determine a destination address for a report or for information from a report. For example, the reporting instructions 236 may be configured to identify a destination address for a communication regarding an outcome of a lottery game and then transmit relevant information to the destination address, which may correspond to an IP address, MAC address, user identity, etc. As such, the reporting instructions 236 may be configured to transmit information to particular users 124 regarding their outcomes for a lottery game directly to the user's 124 portable gaming device 128.

Figure 3:
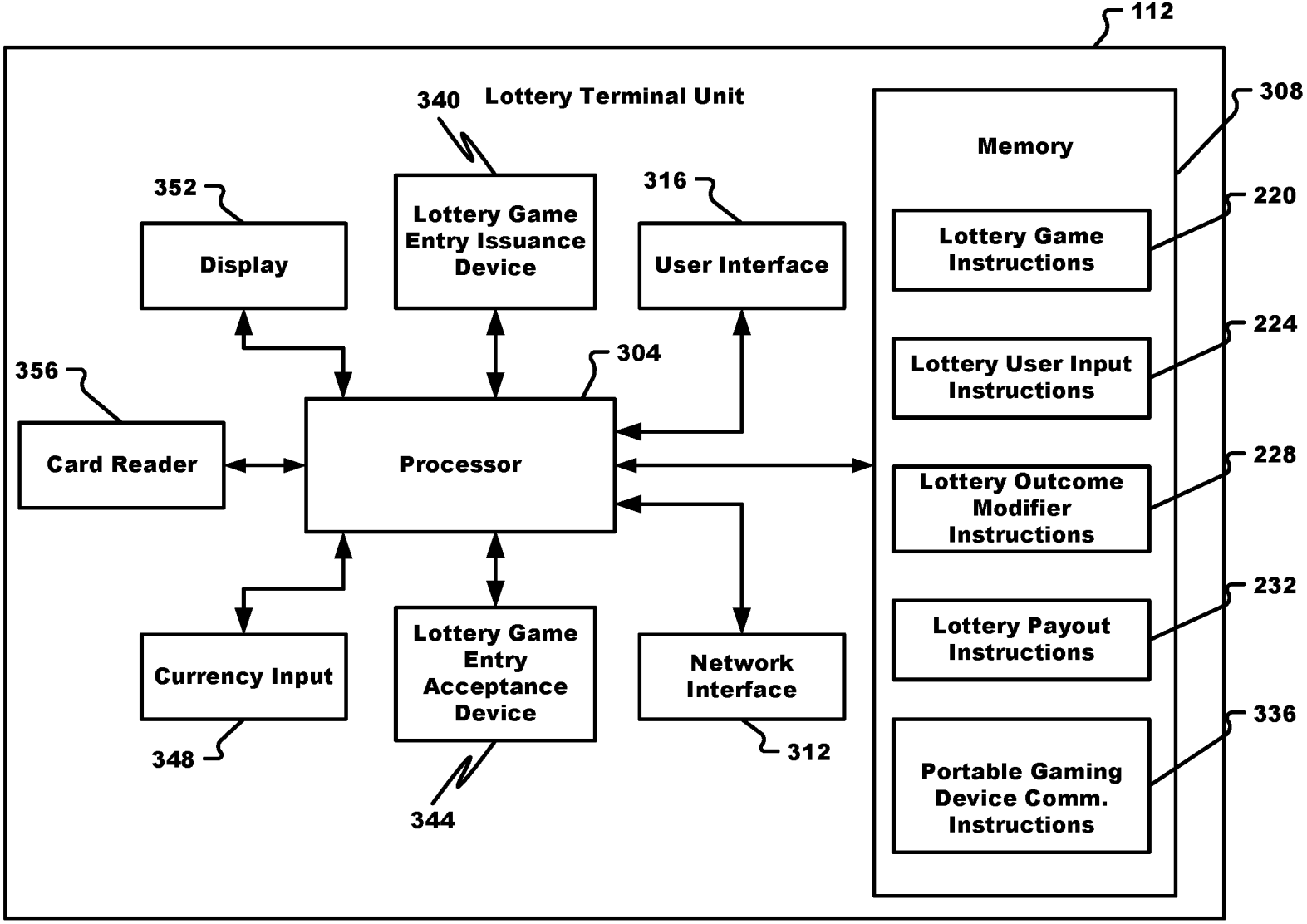
FIG. 3 illustrates a lottery terminal unit in accordance with embodiments of the present disclosure.

With reference now to FIG. 3, additional details of the components that may be included in a lottery terminal unit 112 will be described in accordance with at least some embodiments of the present disclosure.

A lottery terminal unit 112 may correspond to a portable or non-portable device used for allowing the entry of information to enable a user 124 to participate in a lottery game (such as Lotto™, Little Lottos™, Dailies™, multi-state games, Mega Millions™, and instant games) without departing from the scope of the present disclosure. Non-limiting examples of a lottery terminal unit 112 include a Retailer Compact™ or Retailer Pro™ lottery terminals sold by IGT™ modified as set forth herein. The illustrative lottery terminal unit 112 depicted herein may include a support structure, housing or cabinet, which provides support for a plurality of displays, inputs, controls and other features of a conventional lottery terminal unit. In some embodiments, a user 124 interacts with a lottery terminal unit 112 while sitting, however, the lottery terminal unit 112 is alternatively configured so that a user can operate it while standing or sitting. The illustrated lottery terminal unit 112 can be positioned on the floor but can be positioned alternatively (i) on a base or stand, (ii) as a pub-style table-top game (e.g., where the participant computational devices are located remotely from the shared wheel as discussed below), (iii) as a stand-alone computational device on the floor of a retailer with other stand-alone computational devices, or (iv) in any other suitable manner. The lottery terminal unit 112 can be constructed with varying cabinet and display configurations.

The lottery terminal unit 112 is shown to include a processor 304, memory 308, a network interface 312, and a user interface 316. In some embodiments, the processor 304 may correspond to one or many microprocessors, CPUs, microcontrollers, Integrated Circuit (IC) chips, or the like. The processor 304 may be configured to execute one or more instructions stored in memory 308. In some embodiments, the instructions stored in memory 308, when executed by the processor 304, may enable the lottery terminal unit 112 to provide lottery game play functionality.

The nature of the network interface 312 may depend upon whether the network interface 312 is provided in cabinet-style lottery terminal unit 112 or a mobile lottery terminal unit 112. Examples of a suitable network interface 312 include, without limitation, an Ethernet port, a USB port, an RS-232 port, an RS-485 port, a NIC, an antenna, a driver circuit, a modulator/demodulator, etc. The network interface 312 may include one or multiple different network interfaces depending upon whether the lottery terminal unit 112 is connecting to a single lottery network 104 or multiple different types of lottery networks 104. For instance, the lottery terminal unit 112 may be provided with both a wired network interface 312 and a wireless network interface 312 without departing from the scope of the present disclosure.

The user interface 316 and display 352 may include a combination of user input devices and user output devices. For instance, the user interface 316 may include speakers, buttons, levers, or any other device that is capable of enabling user 124 interaction with the lottery terminal unit 112, and the display 352 can include a cathode ray tube display, liquid crystal display, light emitting diode display, plasma display, or organic light emitting diode display and may or may not be touch-sensitive. The user interface 316 may also include one or more drivers for the various hardware components that enable user 124 interaction with the lottery terminal unit 112.

The memory 308 may include one or multiple computer memory devices that are volatile or non-volatile. The memory 308 may be configured to store instructions that enable user interaction with the lottery terminal unit 112 and that enable game play at the lottery terminal unit 112. Examples of instructions that may be stored in the memory 308 include the lottery game instructions 220, the lottery user input instructions 224, the lottery outcome modifier instructions 228, and the lottery payout instructions 232. Functions of the lottery terminal unit 112 enabled by these various instructions are described above in connection with FIG. 2. It should be appreciated that the instructions depicted in FIG. 3 may be combined (partially or completely) with other instructions or may be further separated into additional and different instructions, depending upon configuration preferences for the lottery server 116, portable gaming device 128, gaming machine 118, and lottery terminal units 112. Said another way, the particular instructions depicted in FIG. 3 should not be construed as limiting embodiments described herein.

The lottery terminal unit 112 is also shown to include a portable gaming device communication instructions 336 that may enable the lottery terminal unit 112 to exchange electronic communications with a portable gaming device 128, either directly or indirectly. The portable gaming device communication instructions 336, when executed by the processor 304, may enable the lottery terminal unit 112 to communicate with the portable gaming device 128 or multiple portable gaming devices 128. In some embodiments, the portable gaming device communication instructions 336 may include instructions that enable the lottery terminal unit 112 to pair with a portable gaming device 128 and establish a communication channel with the portable gaming device 128 via the pairing. As an example, the portable gaming device communication instructions 336 may include instructions that enable NFC, Bluetooth®, WiFi, or other types of communication protocols. It should be appreciated that the portable gaming device communication instructions 336 may also be updated to reflect when a portable gaming device 128 is paired with the lottery terminal unit 112 and such pairing information may include addressing information for the portable gaming device 128 and/or identification information associated with the user 124 of the portable gaming device 128. Alternatively or additionally, the portable gaming device communication instructions 336 may enable the lottery terminal unit 112 to identify a user 124 of the portable gaming device 128, identify a loyalty account associated with the user 124 of the portable gaming device 128, exchange information (e.g., send or receive) with a loyalty application operating on the portable gaming device 128, or combinations thereof. In some embodiments, the portable gaming device communication instructions 336 may be configured to operate or drive the network interface 312 to facilitate direct or indirect communications with a portable gaming device 128.

The lottery terminal unit 112 can include other instructions sets (not shown), such as an attraction sequence instructions that may be performed in an attempt to induce a potential user to play the lottery terminal unit 102. The attraction sequence may be performed by displaying one or more video images on the user interface 316 and/or display 352 and/or causing one or more sound speakers, such as voice or music, to be generated via speakers in the user interface 316. The attraction sequence may include a scrolling list of video lottery games that may be played on the lottery terminal unit 112 and/or images of various lottery games being played, such as video poker, video Keno, video blackjack and the like. During performance of the attraction sequence, if a potential user makes any input via the user interface 316 or currency input 348 to the lottery terminal unit 112, the attraction sequence may be terminated and a game-selection display may be generated on the display 352 to allow the user to select a lottery game available on the lottery terminal unit 112. The game-selection display 352 may include, for example, a list of video lottery games that may be played on the lottery terminal unit 112 and/or a visual message to prompt the user to deposit value into the lottery terminal unit 112.

While shown as separate instructions, it should be appreciated that the various instructions sets can be combined in any suitable manner based on the implementation requirements without departing from the scope of the present disclosure.

The lottery terminal unit 112 is further shown to include a lottery game entry issuance device 340, a lottery game entry acceptance device 344, a currency input device 348, and a card reader 356. The lottery game entry issuance device 340 may be configured to print physical lottery tickets. The lottery game entry acceptance device 344 may be configured to receive, scan, and/or recognize information from an input physical lottery ticket. In some embodiments, the lottery game entry acceptance device 344 may be configured to read a ticket serial number from the lottery ticket. In such embodiments, the lottery game entry acceptance device may include one or more machine vision hardware components and one or more decoding devices that are capable of analyzing the images of the lottery ticket and automatically identifying a serial number thereon regardless of whether the serial number is in a human-readable format and/or a machine-readable format. In some embodiments, the lottery game entry issuance device 340 and lottery game entry acceptance device 344 may operate in concert with a common piece of hardware that both accepts and produces physical tickets. Tickets printed by lottery game entry issuance device 340 and recognizable by the lottery game entry acceptance device 344 may correspond to physical lottery tickets. Alternatively or additionally, the lottery game entry issuance device 340 and/or lottery game entry acceptance device 344 may be connected to ticket or cash reading hardware. In such an embodiment, the lottery game entry issuance device 340 and lottery game entry acceptance device 344 may operate as a driver and/or firmware component for the card reader.

Similarly, the currency input device 348 may include or operate in concert with a coin slot or any other type of coin delivery mechanism. The currency input device 348 may include hardware, drivers, or firmware that facilitate receiving tokens, coins, chips, etc. In some embodiments, the currency input device 348 may be configured to determine an amount of coins (an amount of tokens, an amount of chips, etc., input at the coin slot and convert the values into credits for playing lottery games.

The card reader 356 may include hardware and/or software configured to read or accept any type of card or portable credential. In some embodiments, the card reader 356 may include hardware and/or software that enable contactless reading of a card or portable credential (e.g., NFC, Bluetooth, Wifi, etc.). In some embodiments, the card reader 156 may include hardware and/or software that enable contact-based reading of a card or portable credential (e.g., magstripe, chip reader, electrodes, card-receiving slot, etc.). It should be appreciated that the card reader 156 may be configured to receive and read a card or portable credential in any type of format (e.g., portable plastic card, magstripe card, key fob, etc.). It should also be appreciated that the card reader 156 may be configured to write information or data onto a card or portable credential. Furthermore, in some embodiments, the card reader 156 may be configured to read a user loyalty card in the form of a plastic credit-card shaped credential. In some embodiments, the card reader 156 may enable communications with a loyalty application operating on a user's portable gaming device 128. A user can be issued a user identification card that has an encoded user identification number that uniquely identifies the user. When the user's playing tracking card is inserted into the card reader 356, the card reader reads the user identification number off the user tracking card to identify the user. The gaming device timely tracks any suitable information or data relating to the identified user's session with the lottery terminal unit 112.

Figure 4:
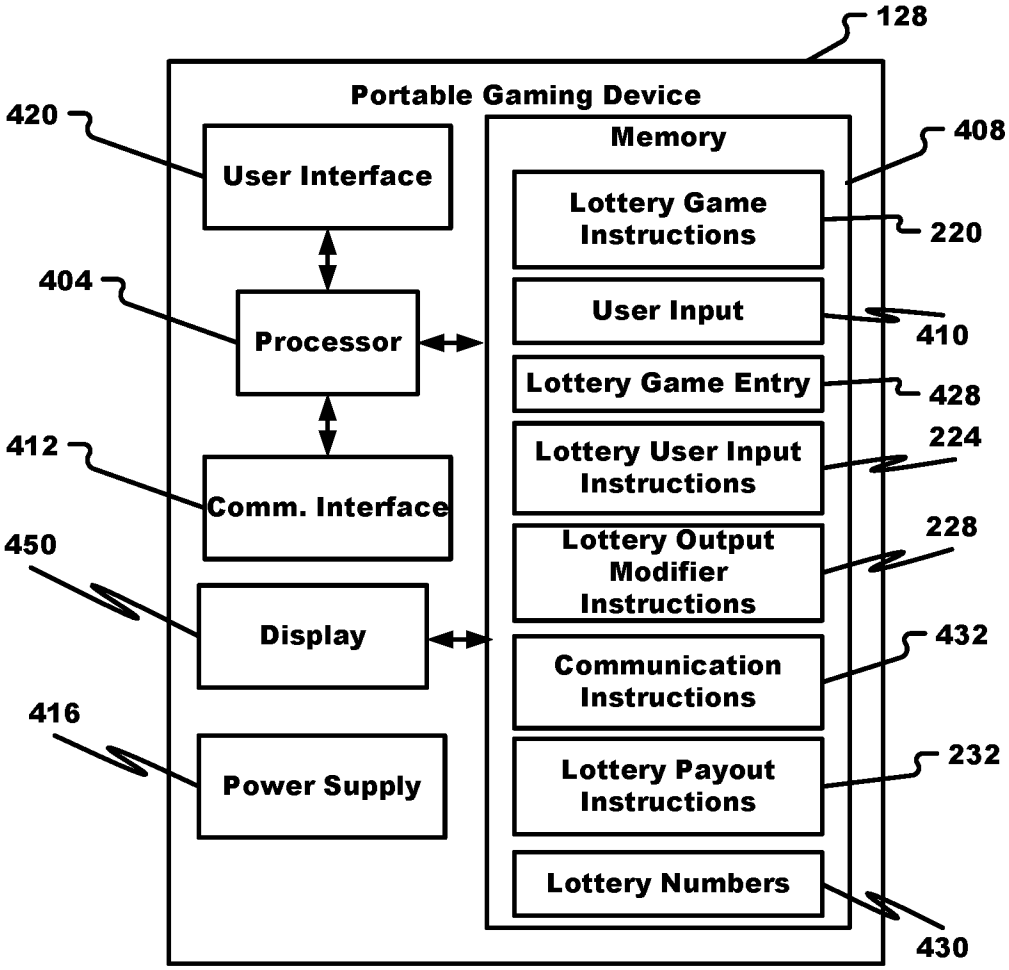
FIG. 4 illustrates a portable gaming device in accordance with embodiments of the present disclosure.

With reference now to FIG. 4, additional details of the components that may be included in a portable gaming device 128 will be described in accordance with at least some embodiments of the present disclosure. The portable gaming device 128 is shown to include a processor 404, memory 408, a communication interface 412, and a user interface 420. In some embodiments, the processor 404 may be similar or identical to any of the other processors 204, 304 depicted and described herein and may correspond to one or many microprocessors, CPUs, microcontrollers, Integrated Circuit (IC) chips, or the like. The processor 404 may be configured to execute one or more instructions stored in memory 408. In some embodiments, the instructions stored in memory 408, when executed by the processor 404, may enable the portable gaming device 128 to provide game play functionality, interact with lottery terminal units 112 and gaming machines 118, pair with lottery terminal units 112 and gaming machines 118, or any other type of desired functionality.

The communication interface 412 may be similar or identical to the network interface 212 and/or communication interfaces 312, 316 depicted and described herein. The nature of the communication interface 412 may depend upon the type of communication network 108 for which the portable gaming device 128 is configured. Examples of a suitable communication interfaces 412 include, without limitation, a WiFi antenna and driver circuit, a Bluetooth antenna and driver circuit, a cellular communication antenna and driver circuit, a modulator/demodulator, etc. The communication interface 412 may include one or multiple different network interfaces depending upon whether the portable gaming device 128 is connecting to a single communication network 108 or multiple different types of communication networks. For instance, the portable gaming device 128 may be provided with both a wired communication interface 412 and a wireless communication interface 412 without departing from the scope of the present disclosure.

The user interface 420 and display 450 may include a combination of a user input and user output device. For instance, the user interface 420 may include a microphone, a speaker, a haptic feedback device, a light, a button, or a combination thereof, and the display 450 can include a cathode ray tube display, liquid crystal display, light emitting diode display, plasma display, or organic light emitting diode display and may or may not be touch-sensitive. The user interface 420 may also include one or more drivers for the various hardware components that enable user interaction with the portable gaming device 128.

The memory 408 may be similar or identical to other memory 208, 308 depicted and described herein and may include one or multiple computer memory devices that are volatile or non-volatile. The memory 408 may be configured to store instructions that enable user interaction with the portable gaming device 128 and that enable game play at the portable gaming device 128. Examples of instructions that may be stored in the memory 408 include the lottery game instructions 220, lottery user input instructions 224, lottery output modifier instructions 228, lottery payout instructions 232, and a communication instructions 432. In addition to the instructions, the memory 408 may also be configured to store data that is useable by the various instructions. Examples of such data that may be stored in memory 408 include, without limitation, the lottery game entry 428, lottery numbers 430 (which correspond in many applications to the winning result of the lottery game), and user inputs 410 from user play of the secondary game.

Functions of the lottery terminal unit 112 enabled by these various instructions are described above in connection with FIG. 2. It should be appreciated that the instructions depicted in FIG. 4 may be combined (partially or completely) with other instructions or may be further separated into additional and different instructions, depending upon configuration preferences for the lottery server 116, portable gaming device 128, gaming machine 118, and lottery terminal units 112. Said another way, the particular instructions depicted in FIG. 4 should not be construed as limiting embodiments described herein.

The lottery game entry 428 and lottery numbers 430 from an occurrence of a lottery drawing may be compared by the lottery game instructions 220 to determine whether the lottery game entry corresponds to a winning result. Because the lottery numbers 430 are also stored in local memory 408 of the portable gaming device 128, the user 124 can check his/her assigned lottery numbers at will and regardless of whether or not the portable gaming device 128 is connected to the communication network 108. The lottery game entry 428 and user inputs 410 from the secondary game may be cleared from memory 408 or be marked with a particular timestamp indicating when the lottery game entry 428 was acquired by the user or the user inputs 410 were received from the user, thereby ensuring that only currently-assigned lottery game entries 428 or active user inputs 410 are maintained in the portable gaming device 128.

The communication instructions 432, when executed by the processor 404, may enable the portable gaming device 128 to communicate via the communication network 108. In some embodiments, the communication instructions 432 may be similar or identical to the communication instructions 336 and may be particular to the type of communication network 108 used by the portable gaming device 128. As an example, the communication instructions 432 may be configured to enable cellular, WiFi, and/or Bluetooth communications with other devices. The communication instructions 432 may follow predefined communication protocols and, in some embodiments, may enable the portable gaming device 128 to remain paired with a lottery terminal unit 112 or gaming machine 118 as long as the portable gaming device 128 is within a predetermined proximity (e.g., 20-30 feet, an NFC communication range, or a Bluetooth communication range) and paired with the gaming machine 112.

The portable gaming device 416 is also shown to include a power supply 416. The power supply 416 may correspond to an internal power supply that provides AC and/or DC power to components of the portable gaming device 128. In some embodiments, the power supply 416 may correspond to one or multiple batteries. Alternatively or additionally, the power supply 416 may include a power adapter that converts AC power into DC power for direct application to components of the portable gaming device 128, for charging a battery, for charging a capacitor, or a combination thereof.

The gaming machine 118 can be any electronic gaming machine capable of interacting with a user to play a secondary game. Non-limiting examples of gaming machines 118 include electronic gaming machines (EGMs), virtual gaming machines (VGMs), video game gambling machines, a video lottery terminals, and electronic table games (ETGs). Like the lottery terminal units 112 and portable gaming device 128, a gaming machine includes a processor (not shown), such as processor 204 of lottery server 116, processor 304 of lottery terminal unit 112, or processor 404 of portable gaming device 128, and memory (not shown), such as memory 208 of lottery server 116, memory 308 of lottery terminal unit 112, or memory 408 of portable gaming device 128, as well as a user interface (not shown), such as user interface 316 and display 352 of lottery terminal unit 112 or user interface 420 and display 450 of portable gaming device 128.

Examples of instructions that may be stored in the gaming machine memory include the lottery game instructions 220, lottery user input instructions 224, lottery output modifier instructions 228, lottery payout instructions 232, and a portable gaming device communication instructions 336 to communicate with the portable gaming device 128 and communication instructions 432 to communicate with the lottery server 116. In addition to the instructions, the memory 408 may also be configured to store data that is useable by the various instructions. Examples of such data that may be stored in memory 408 include, without limitation, the lottery game entry 428 and user inputs 410 from user play of the secondary game.

Functions of the gaming machine 118 enabled by these various instructions are described above in connection with FIG. 2. It should be appreciated that the instructions may be combined (partially or completely) with other instructions or may be further separated into additional and different instructions, depending upon configuration preferences for the lottery server 116, portable gaming device 128, gaming machine 118, and lottery terminal units 112. Said another way, the particular instructions should not be construed as limiting embodiments described herein.

Figure 5A:
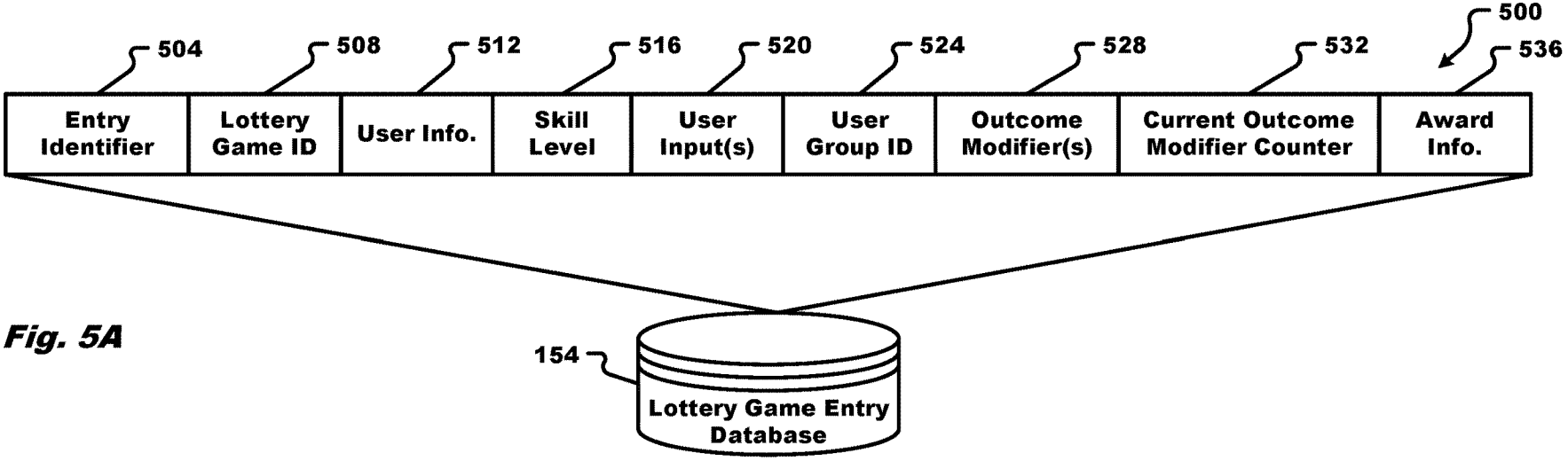
FIG. 5A illustrates a lottery game entry database in accordance with embodiments of the present disclosure.

With reference now to FIG. 5A, additional details of data that may be stored in the lottery game entry database 154 will be described in accordance with at least some embodiments of the present disclosure. The database 154 may be configured to store one or multiple data structures 500 that are used in connection with lottery game entries of users. In some embodiments, the data stored in the data structures 500 may be stored for a plurality of different lottery game entry profiles or for a single lottery game entry profile. The data structure 500 may include a plurality of data fields that include, for instance, a lottery game entry identifier field 504, a lottery game identifier field 508, user information field 512, a skill level field 416, a user input(s) field 516, a user group ID field 524, an outcome modifier(s) field 428, a current outcome modifier counter 532, and an award information field 536.

The entry identifier field 504 may be used to store any type of information that identifies a digital or physical lottery game entry. The entry identifier field 504 is typically a unique identifier, such as a barcode, QR code, Globally Unique Identifier ("GUUID"), Universally Unique Identifier ("UUID"), or the like, assigned by the lottery server 116 or lottery terminal unit 112 to a lottery game entry or ticket. The entry identifier field 504 can include other information, such as a sequence of lottery numbers and/or other characters generated for the lottery game entry (which is compared against the winning result, or sequence of drawn numbers or characters for the lottery game, to determine whether the sequence generated for the lottery game entry corresponds to a winning outcome), a timestamp on which the lottery game entry was generated and/or purchased by the user, and a digital image of the lottery game entry. The entry identifier field 504 may also include a lottery game entry validity period (describing the times during which the lottery game entry may be validly redeemed), a lottery game entry status (describing whether or not the lottery game entry is still valid or active), a lottery game entry redemption amount (describing the lottery game entry value when redeemed following the lottery game entry being determined by the lottery server 116 to correspond to a winning result of the lottery game), an identifier associated with the user 124, a timestamp or date on which the lottery ticket was printed, an identifier of the lottery terminal unit that printed the lottery ticket, or a combination thereof. In some embodiments, when the lottery terminal unit 112 prints the physical lottery ticket, the lottery terminal unit 112 may report such a printing action back to the lottery server 116, thereby enabling the game server 116 to track which lottery numbers were assigned to the user 124 when the lottery ticket was printed.

The lottery game identifier field 508 may be used to store any type of information that identifies a lottery game corresponding to the lottery game entry. Typically, this field comprises a link to the address of the lottery game identifier field 554 (discussed below) in the lottery game database 150.

The user information field 512 may be used to store any type of information that identifies a user 124 associated with the lottery game entry. For instance, the user 124 may have purchased the lottery game entry from a lottery terminal unit 112. In some embodiments, the user information field 512 may store one or more of username information for a user 124, contact information for the user (such as email address, residential address, phone number, social website webpage universal resource locator, and the like), password information or other credentials for a user account, user status information, user secondary game preferences, and any other type of customer service management data that may be stored with respect to a user 124.

The skill level field 516 may be used to store data about the user's current skill level associated with the secondary game. The skill level may be assigned to the user 124 by any number of methods. For instance, the skill level may be related to a proficiency of the user in playing the secondary game as reflected by a secondary game point score, prize or bonus winnings, or other event achievements of the user. By way of further illustration, the skill level may be purchased by the user 124 from the lottery system 102. Other methodologies will be envisioned by one of ordinary skill in the art for assigning a skill level to a user.

The user input(s) field 520 may be used to store data about the secondary game outcomes for the user. The field 520 may comprise multiple sets of user input(s), each corresponding to a different timestamp. As noted, the user input(s) can take many forms, such as a secondary game score, a secondary game bonus, prize, or other award, or other indicator of user secondary game proficiency or event accomplishment.

The user group identifier (ID) field 524 may be used to store the identifier of a user group to which the user belongs, the entry identifiers 504 of each of the members of the user group, or the links to the user information fields 512 of each of the members of the user group.

The outcome modifier(s) field 528 may be used to store the outcome modifiers derived or determined from each of the sets of user input(s) in the user input(s) field 520. Each outcome modifier is linked to the corresponding set of user input(s) in the user input(s) field 520 or is identified by a common timestamp associated with the corresponding set of user input(s). In one embodiment, a variable, namely the current outcome modifier, stores an outcome modifier value to be applied to determine the corresponding user's share of the winning lottery amount.

The current outcome modifier counter field 532 may be used to store the current value of the outcome modifier counter. As noted, the outcome modifier counter is used to determine whether or not the user has a predetermined number of secondary game plays. When the outcome modifier current value is at the predetermined number when configured as a count-up variable or at zero when configured as a count-down variable, the user is not eligible for further secondary game play.

The award information field 536 may be used to store the lottery game payout(s) made to the lottery game entry corresponding to the data structures 500.

Figure 5B:
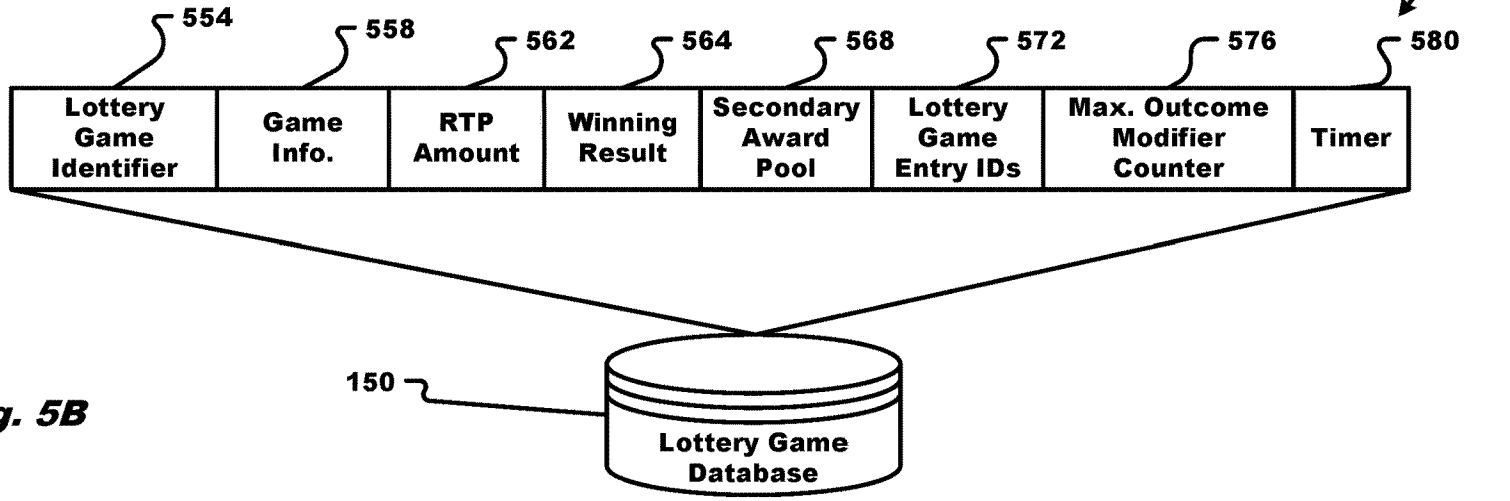
FIG. 5B illustrates a lottery game database in accordance with embodiments of the present disclosure.

With reference now to FIG. 5B, additional details of data that may be stored in the lottery game database 150 will be described in accordance with at least some embodiments of the present disclosure. The database 150 may be configured to store one or multiple data structures 550 that are used in connection with lottery games. In some embodiments, the data stored in the data structures 550 may be stored for a plurality of different lottery game profiles. The data structure 550 may include a plurality of data fields that include, for instance, a lottery game identifier field 554, a lottery game information field 558, an RTP amount field 562, a jackpot field 564, a secondary award pool field 568, a lottery game entry identifiers field 572, a maximum outcome modifier counter field 576, a timer field 580, and a winning result field 564.

The lottery game identifier field 554 may be used to store a unique identifier, such as a GUID or UUID, of each of the lottery games having an entry in the database 150.

The game information field 558 may be used to store lottery game information, such as a description of the corresponding lottery game and secondary game, specifications and rules for the corresponding lottery and secondary games, and the like.

The RTP amount field 562 may be used to store the Return to Player ("RTP") amount for the corresponding lottery game.

The winning result field 564 may be used to store a current winnings payout for the corresponding lottery game.

The secondary award pool field 568 may be used to store the difference between the RTP amount in the RTP amount field 562 and the current winnings payout in the jackpot field 564. The difference may be returned to winning lottery game entries pursuant to rules specified in the game information field 558. As the difference is returned to users in the form of winnings payouts, the current value in the jackpot field 564 may be incremented and the current value in the secondary award pool field 568 decremented in one configuration, or the current value in the jackpot field 564 may be decremented and the current value in the secondary award pool field 568 incremented in another configuration.

The lottery game entry identifiers field 572 may be used to store links to each of the lottery game entry identifiers in the entry identifier field 504 that correspond to the lottery game referenced in the lottery game identifier field 554.

The maximum outcome modifier counter field 576 may be used to store the maximum (for a count-up variable configuration) or minimum (for a count-down variable configuration) predetermined value of the outcome modifier counter. When the outcome modifier current value is at the predetermined number when configured as a count-up variable or at zero when configured as a count-down variable, the user is not eligible for further secondary game play.

The timer field 580 may be used to store the beginning and ending dates for the lottery game as well as a current date.

The various fields in the data structures 500 and 550 enable each of the lottery system 102, gaming machines 118, and portable gaming device 128 to update the user input(s) field 520 to reflect user input(s) received through user secondary game gameplay and determine from each set of user input(s) in the user input(s) field 520 a corresponding outcome modifier value to update the outcome modifier(s) field 528. Stated differently, for a common lottery game identified in the lottery game identifier field 554, a first set of user input(s) for first secondary game instance played by a first user corresponds to a first outcome modifier value in the outcome modifier(s) field 528 and a second set of user input(s) for a second secondary game instance played by the first user corresponds to a second outcome modifier value in the outcome modifier(s) field 528. The user group ID field 524 enables the first user and other members in an identified user group including the first user to obtain a highest outcome modifier determined for all of the sets of user input(s) received from all of the members of the user group.

With reference now to FIGS. 6-9, various operations of a gaming system 100 will be described in accordance with at least some embodiments of the present disclosure. It should be appreciated that any of the methods or the method steps depicted and described herein can be performed by any device depicted and described herein and may be performed in an order other than the order depicted. Moreover, steps from one method may be performed in another method without departing from the scope of the present disclosure.

Figure 6:
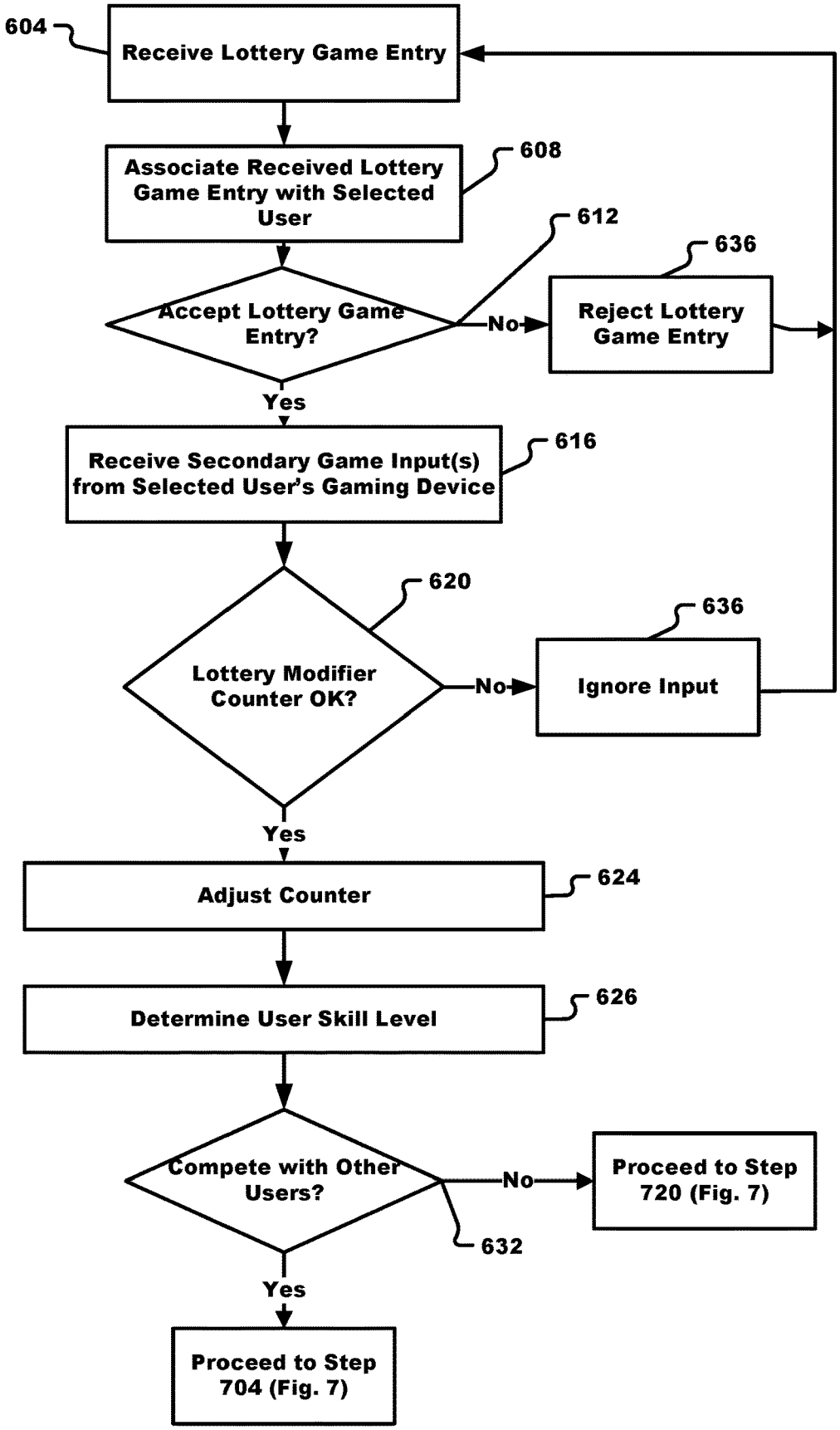
FIG. 6 is a flow chart illustrating a gaming method in accordance with embodiments of the present disclosure.

Referring initially to FIG. 6, a first method will be described in accordance with at least some embodiments of the present disclosure. The method can begin with the lottery server 116 receiving a digital representation of the lottery game entry from the lottery terminal unit 112, gaming machine 118, or portable gaming device 128 (step 604). The lottery numbers that are assigned to the user 124 may correspond to a single set of lottery numbers (e.g., one lottery entry) or a plurality of sets of lottery numbers (e.g., a plurality of lottery entries).

The method may continue with the lottery server 116 querying the lottery game entry database 154 in an attempt to associate the received lottery game entry with a particular user 124 (step 608). This can be done by the database querying the database 154 to match an identifier of the received lottery game entry, via entry identifier field 504 with a corresponding user information field 512.

The method may then continue by the lottery server 116 determining whether or not to accept the lottery game entry (step 612). The received lottery game entry is determined not to be valid when it fails to match a valid entry identifier in the entry identifier field 504. When the lottery game entry fails to match a valid entry identifier, the lottery server 116 rejects the lottery game entry (step 636) and returns to step 604.

When the lottery game entry matches a valid entry identifier, the lottery server 116 accepts the lottery game entry and receives, from the lottery terminal unit 112, gaming machine 118, or portable gaming device 128, game input(s) received, via a secondary game play, from the corresponding selected user identified in the corresponding user information field 512 (step 616). The lottery server 116 may further query the lottery game entry and lottery game databases 154 and 150 for the current values in the current outcome modifier counter field 532 and maximum outcome modifier counter field 576, respectively.

The method may then continue by the lottery server 116 determining whether or not the current lottery modifier counter equals the value of the maximum outcome modifier counter field 576 (step 620). When the current lottery modifier counter equals the value of the maximum outcome modifier counter field 576, the lottery server 116 ignores the received user input(s) as the user is not eligible to play additional secondary game instances (step 636) and returns to step 604.

When the current lottery modifier counter is less than the value of the maximum outcome modifier counter field 576, the lottery server 116 accepts the received user input(s) as the user is eligible to play additional secondary game instances and increments the lottery modifier counter (step 624).

The method may then continue by the lottery server 116 querying the lottery game entry database 154 to determine a user skill level of the selected user stored in skill level field 516 (step 626). If the lottery game does not recognize user skill level as part of the secondary game input(s), the lottery server can skip this step.

Figure 7:
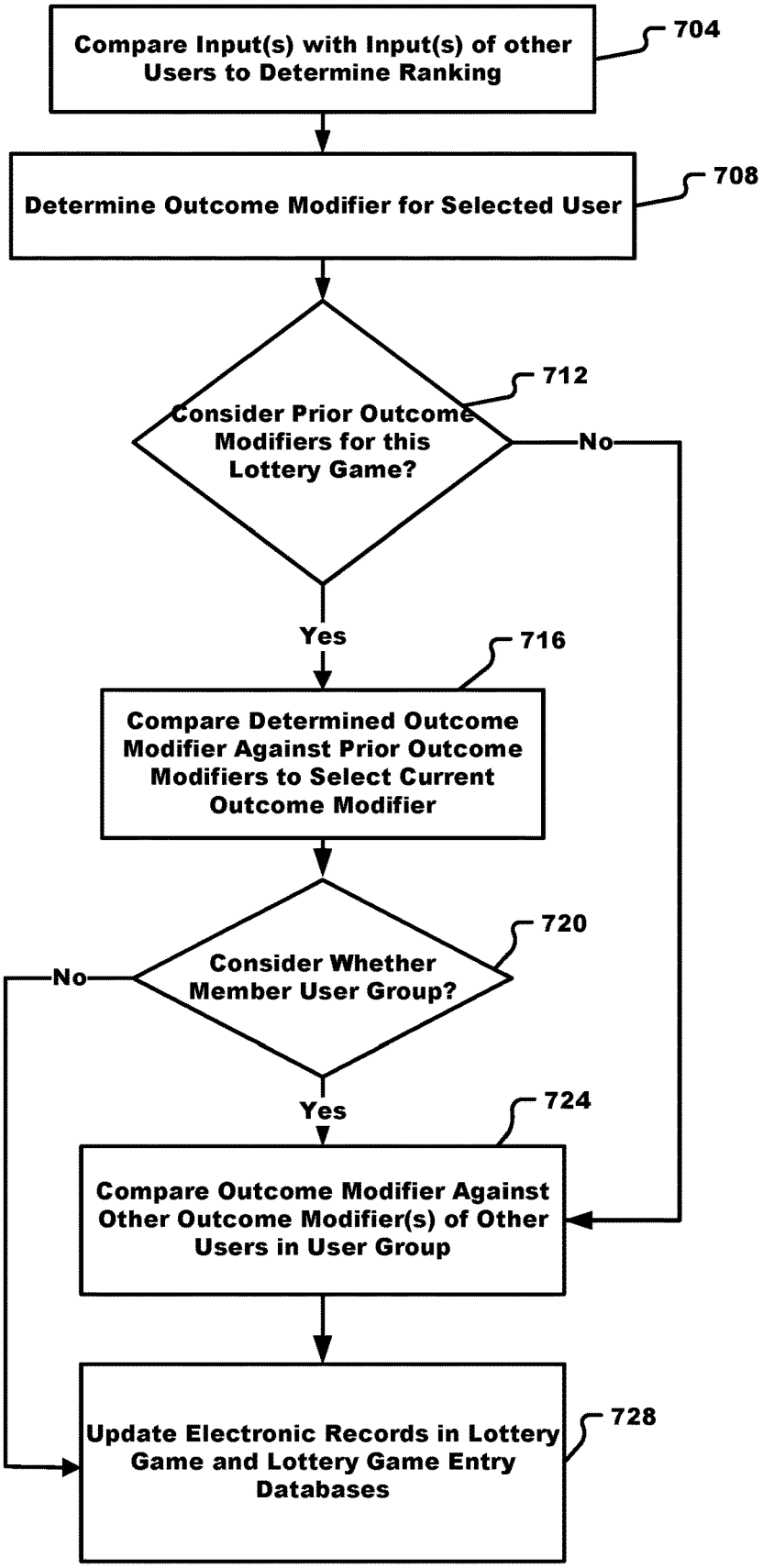
FIG. 7 is a flow chart illustrating a gaming method in accordance with embodiments of the present disclosure.

The method may then continue by the lottery server determining from the game information field 558 whether the selected user is competing on an individual or group basis with other users with respect to converting the selected user input(s) into an outcome modifier (step 632). When the selected user is not competing on either an individual or group basis with other users, the lottery server 116 proceeds to step 720 (FIG. 7) and when the selected user is competing on either an individual or group basis with other users, the lottery server 116 proceeds to step 704 (FIG. 7).

The first method will be further discussed with reference to FIG. 7.

The method may continue by the lottery server 116 receiving from the lottery game entry database 154 the sets of user input(s) in the user input(s) fields 520 of other users and comparing the sets of input(s) with one another to determine a secondary game proficiency ranking of the selected user relative to the secondary game proficiency rankings of other users (step 704). As noted above, this can be done on a user-by-user basis or a user group-by-user group basis.

The method may continue by the lottery server 116 determining an outcome modifier for the selected user based on the absolute or relative proficiency ranking of the selected user or his or her user group compared to other users or user groups, as appropriate (step 708). In the former case (where there is no inter-user competition), the outcome modifier is determined based only on the set of user input(s) of the user for the current secondary game instance. In the latter case (where there is inter-user competition), the outcome modifier is determined based on one or more sets of input(s) from other users (whether individual or group member users).

The method may continue by the lottery server 116 determining whether or not to consider prior outcome modifiers received from the selected user for the subject lottery game (step 712). In some embodiments, the user is permitted to play only a single instance of a secondary game and in other embodiments, the user is permitted to play a predetermined or unlimited number of secondary game instances. When the user is permitted to play only a single instance of a secondary game, the lottery server 116 proceeds to step 724 discussed below. When the user is permitted to play a predetermined or unlimited number of secondary game instances, the lottery server 116 proceeds to step 716.

The method may continue by the lottery server 116 retrieving from the lottery game entry database 154 the outcome modifier values stored in the outcome modifier(s) field 528 and comparing each of the prior outcome modifier values against the determined value of the outcome modifier determined from step 708 (step 716). While the highest outcome modifier value can be selected as the current outcome modifier to be applied to the user share of the winning lottery amount, the selection can determine a current outcome modifier value based on the determined and prior outcome modifier values. For instance, the current outcome modifier value can be an average, median, or mode of the determined and prior outcome modifier values.

The method can continue by the lottery server 116 determining whether or not to consider whether the selected user is a member of a user group (step 720). The lottery server 116 considers whether the selected user is a member of a user group when the previously determined outcome modifier is used in determining the value of the current outcome modifier. Compared to step 632, this embodiment is used when the user group collaboratively and cooperatively works together to share secondary game proficiency performance when there is no inter-group competition. When there is such competition, the lottery server 116 proceeds directly to step (step. When there is no such competition, the lottery server 116 proceeds to the next step.

The method can continue by the lottery server 116 retrieving from the lottery game entry database 154 the current outcome modifier values stored in the outcome modifier(s) field 528 for each of the other user members in the group and comparing the outcome modifier values against one another to determine the current outcome modifier value for each member of the user group, including the selected user (step 724). While this determination can be done by any number of techniques, in one embodiment the highest outcome value of any of the group members is selected as the current outcome modifier value.

The method can continue by the lottery server 116 updating the electronic records in the lottery game and lottery game entry databases 150 and 154 to reflect the various outcome modifier values generated in the first method (step 728).

Figure 8:
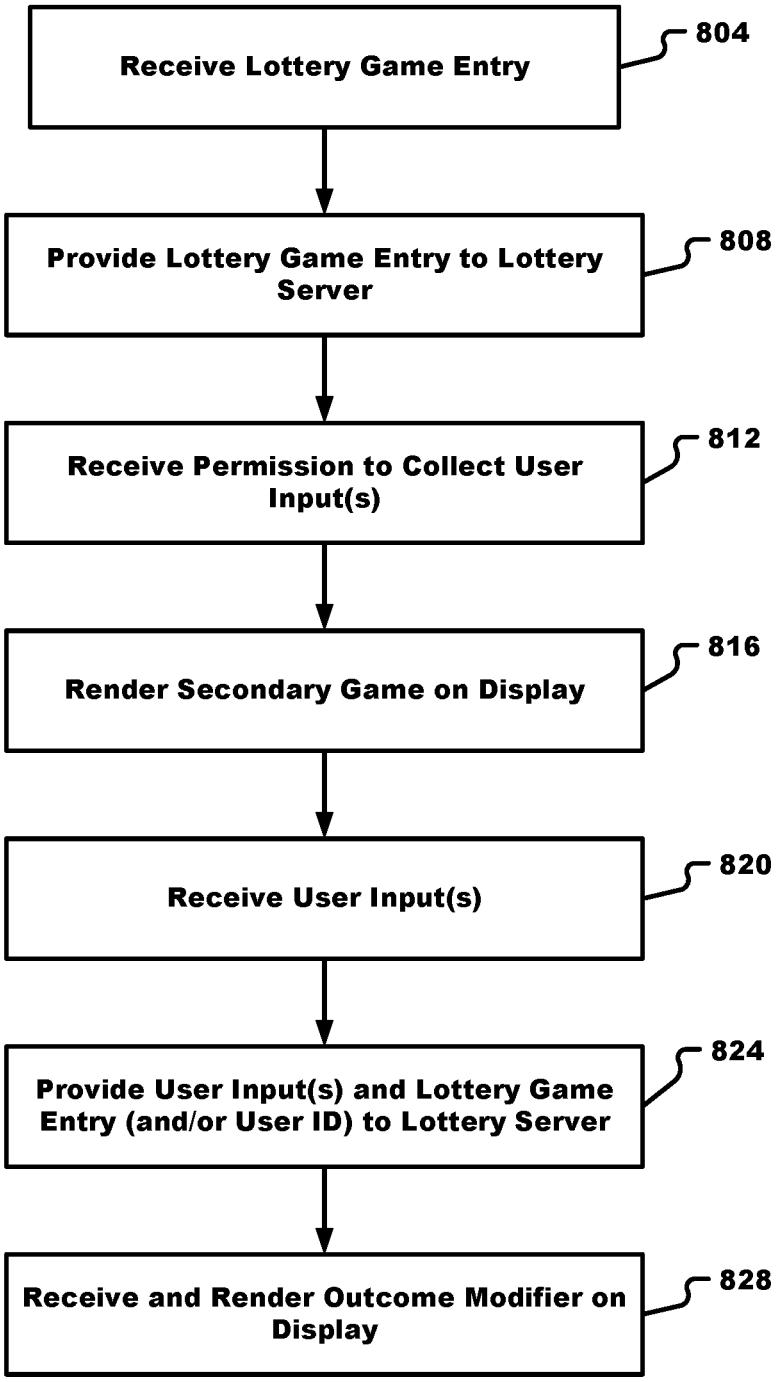
FIG. 8 is a flow chart illustrating a gaming method in accordance with embodiments of the present disclosure.

Referring to FIG. 8, a second method will be described in accordance with at least some embodiments of the present disclosure. The method can begin with the gaming machine 118 or portable gaming device 128 receiving a digital representation of the lottery game entry (step 804). The user can load the lottery game entry onto his or her portable gaming device 128 (e.g., mobile device or personal computing device) via one of many possible transfer means. For example, the user might purchase a lottery game entry in the form of a paper lottery ticket from a lottery terminal unit 112 and then scan it with a lottery mobile application on the portable gaming device 128. In another example, the user might purchase the lottery game entry in digital form (or as an electronic ticket) directly using the lottery mobile application. In another example, the portable gaming device 128 or gaming machine 118 receives a digital image of the lottery game entry directly from the lottery server 116 or lottery terminal unit 112. The electronic lottery ticket can be issued to the portable gaming device 128 using the communication channel established via the pairing between the lottery terminal unit 112 and portable gaming device 128. Alternatively or additionally, the lottery terminal unit 112 may provide information to the lottery server 116 that causes the lottery server 116 to issue the electronic lottery ticket. Thus, in some embodiments, issuance or outputting of a lottery ticket may include physically printing a lottery ticket with lottery numbers associated therewith, assigning lottery numbers with an electronic lottery ticket number and storing the lottery numbers in association with the electronic lottery ticket in memory, or a combination of such issuance actions.

The method may continue by the gaming machine 118 or portable gaming device 128 providing the lottery game entry to the lottery server 116 or lottery terminal unit 112 as part of a request to authorize the user to play an instance of a secondary game (step 808). This request is typically the result of a secondary game play request received from the user via a user interface.

The method may continue by the gaming machine 118 or portable gaming device 128 receiving from the lottery server 116 or lottery terminal unit 112 an authorization message granting permission to collect user input(s) (step 812). The message can include secondary game play instructions and/or an identifier of a secondary game stored in the memory of the gaming machine 118 or portable gaming device 128 to render to the user. The authorization message is typically generated as a result of steps 612 or 620 (FIG. 6).

When the authorization message provides permission to the gaming machine 118 or portable gaming device 128 to collect user input(s), the method may continue by the gaming machine 118 or portable gaming device 128 providing or rendering the secondary game on the display and/or user interface of the gaming machine 118 or portable gaming device 128 (step 816).

The method may continue by the gaming machine 118 or portable gaming device 128 receiving user input(s) (step 820).

The method may then continue by the gaming machine 118 or portable gaming device 128 providing the received user input(s) and the lottery game entry (and/or user identifier of the respective user) to the lottery server 116 (step 824). The lottery server 116 receives the secondary game input(s) in step 616 of FIG. 6.

The method may then continue by the gaming machine 118 or portable gaming device 128 receiving from the lottery server 116 and rendering an outcome modifier derived from the user input(s) on the display of the gaming machine 118 or portable gaming device 128 (step 828). This can be in response to the lottery server 116 performing step 728 (FIG. 7).

Figure 10:
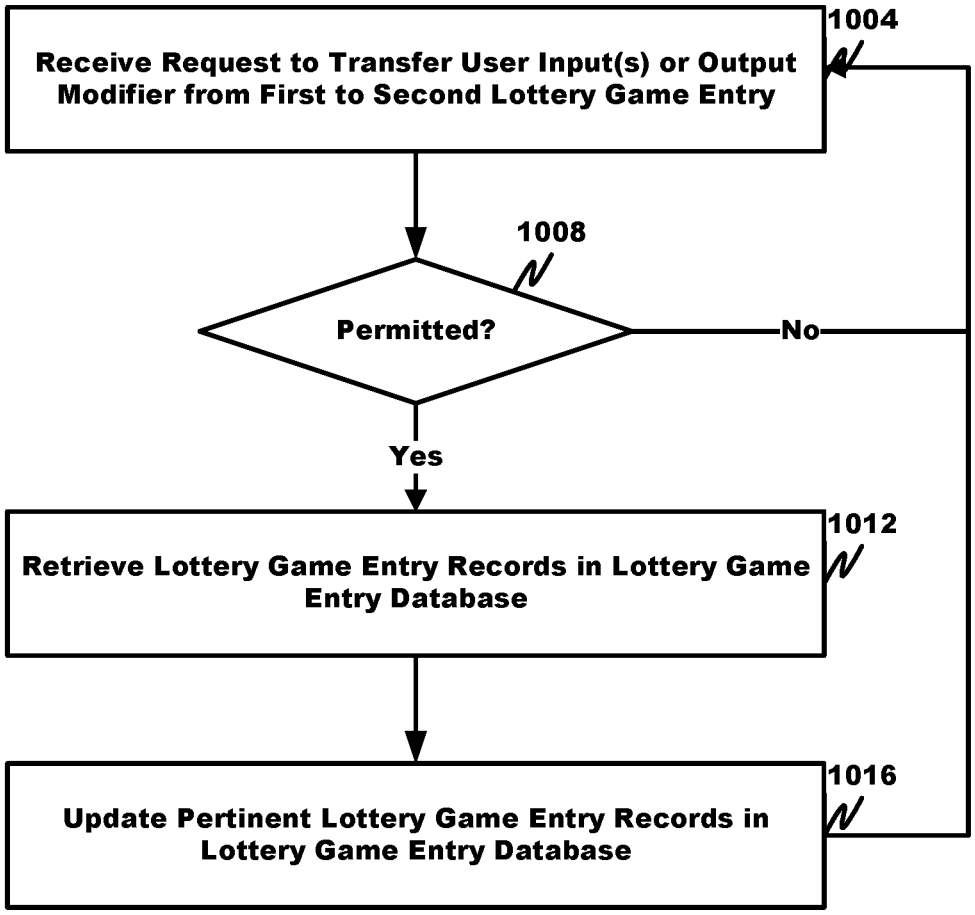
FIG. 10 is a flow chart illustrating a gaming method in accordance with embodiments of the present disclosure.

Referring to FIG. 10, a third method will be described in accordance with at least some embodiments of the present disclosure. The method can begin by the lottery server 116 receiving, from a lottery terminal unit 112, gaming machine 118, or portable gaming device 128, a request to transfer a selected set of user input(s) or output modifier from a first lottery game lottery entry to a different second lottery game entry (step 1004). Depending on the configuration, the request can specify not only the entry identifiers (in the entry identifier field 504) of the first and second lottery game entries but also whether the selected user input(s) or output modifier is to be copied from the first to the second lottery game entry database records such that the selected user input(s) or output modifier is maintained concurrently in the database records of both the first and second lottery game entries or the selected user input(s) or output modifier is to be cut and moved from the first to the second lottery game entry records such that the selected user input(s) or output modifier is maintained in the database record of the second lottery game entry but not concurrently in the database record of the first lottery game entry.

The method can continue by the lottery server 116 determining whether the requested movement of the selected user input(s) or output modifier is permitted (step 1008). This can be done by comparing the requested operation against one or more rule sets. The rule sets, by way of non-limiting example, can specify whether the first and second lottery game entries must be associated with a common identified user, a maximum number of such movements that are permitted by the user, a prerequisite that must be satisfied for such an operation (such as making an additional payment), the types of movements that are permitted or not permitted, and the like.

If the lottery server 116 determines that the requested movement is not permissible, the lottery server 116 can deny the request and return to step 1004.

If the lottery server 116 determines that the requested movement is permissible, the lottery server 116 can continue to step 1012.

The method can continue by the lottery server 116 retrieving from the lottery game entry database 154 the records corresponding to the received entry identifiers for the first and second lottery game entries (step 1012).

The method can continue by the lottery server 116 updating the records in the lottery game entry database 154 (step 1016) and returning to step 1004 to await a next request.

Figure 9:
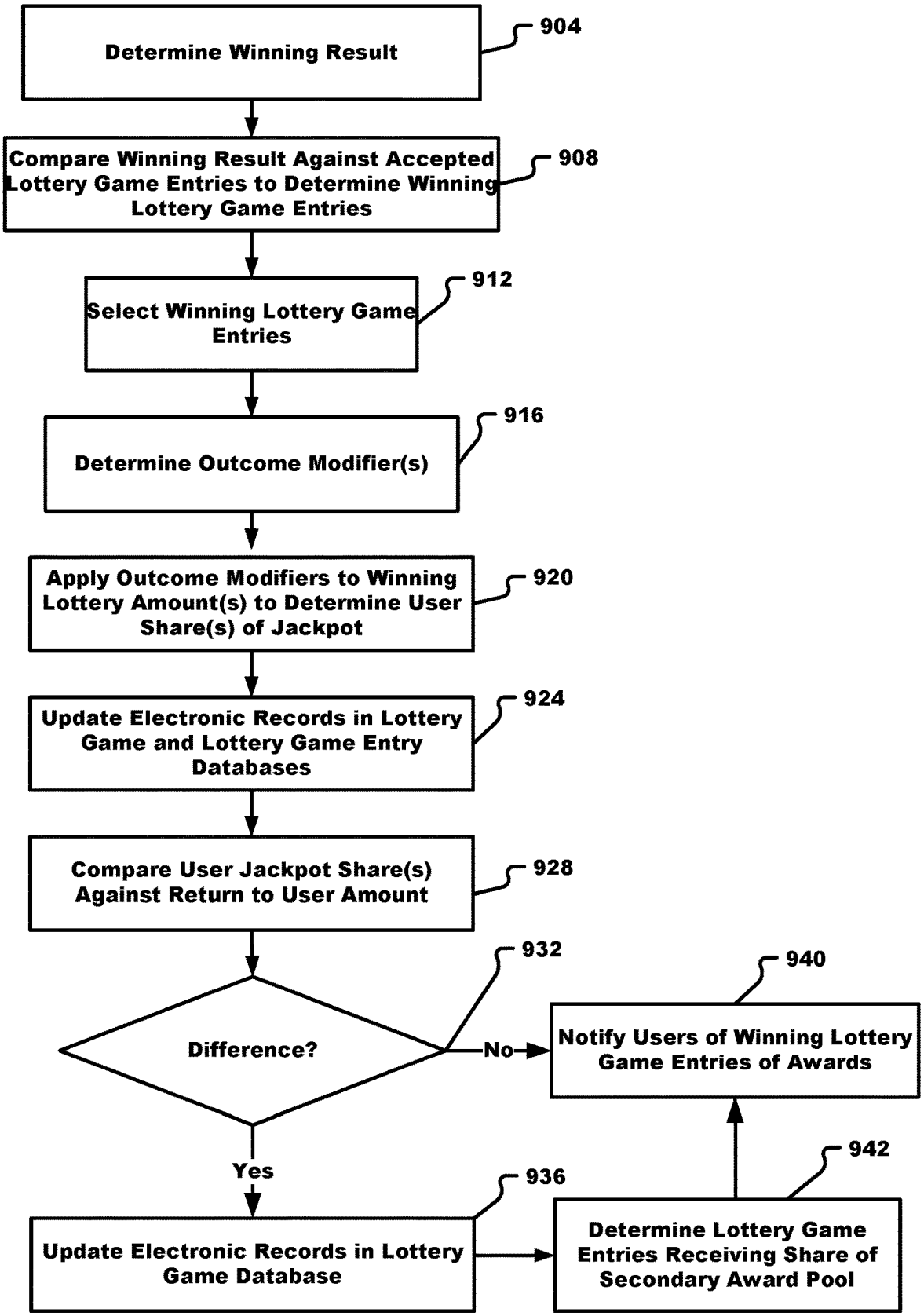
FIG. 9 is a flow chart illustrating a gaming method in accordance with embodiments of the present disclosure.

Referring to FIG. 9, a fourth method will be described in accordance with at least some embodiments of the present disclosure. The method can begin by the lottery server 116 determining a winning result (step 904). After the users' lottery game entries for the lottery game are accepted (step 612 of FIG. 6), the lottery game may be executed to determine one or more winning result(s). The winning result may be determined by a manual drawing or automatically by a random number of pseudorandom number generation. For lottery games involving a drawing, such as Lotto™ Mega Millions™, Powerball™-style games, Keno, Bingo, Pick-3 and Pick-4, the drawings may occur on a specified day and time, or at predetermined intervals, with the users being required to make their entries prior to the drawings. For other lottery games initiated by the users, such as instant win games and scratch-off games, the execution of the game occurs when the user performs the necessary actions with the lottery ticket to play the game. For each of these games, however, the execution of the lottery game involves a distinct process for determining the outcome of an occurrence of the game. Keno games are well known for both lottery games and casino games. In typical Keno games, users select one to ten or one to fifteen numbers from the range of 1 to 80. Bingo is another common lottery and casino game. In Bingo, each user selects one or more game card consisting of a five-by-five matrix of numbers from the range of 1 to 75. Pick-3 and Pick-4 games are somewhat similar to Mega Millions™ or Powerball™-style games and Lotto™ games, in which users select numbers or symbols from a predetermined range of numbers or symbols.

The winning result can take many forms. In a Lotto™ game, the users may wager on how many numbers they can match from a specified range of numbers or symbols. Powerball-style games may be similar to Lotto™ games, with users selecting a subset of a known range of numbers or symbols from multiple ranges of numbers or symbols. In contrast to progressive games such as Lotto™, Mega Millions™, and Powerball-style games, non-progress games, sometimes referred to a Cash Lotto™ may typically be held twice a week and entail the selection of five rather than six numbers from a predefined range of numbers.

Scratch-off lotteries do not involve a separate drawing conducted by the lottery. Instead, the lottery ticket includes indicia for conducting and determining the outcome of the scratch-off game, with the indicia being covered by a material that may be scratched off to expose the indicia disposed there under. For other games, such as pull tab games, the game indicia and/or the entire ticket may be covered by a covering sheet or substrate, with all or portions thereof being removable to expose the game indicia when the game is played by the user. The scratch-off or pull tab games may configured so that each ticket is predetermined to be a winning or losing entry for the game, or configured so that the each ticket may be either a winning or losing entry, with the outcome being determined based on the order or manner in which the user exposes the covered game indicia on the lottery ticket. In the former type of scratch-off or pull tab game, the indicia is configured to indicate whether the ticket is winning or losing entry, and the user merely removes the covering to expose the indicia and evaluates the indicia to determine whether the ticket is a winning or losing ticket. Any user purchasing the ticket will achieve the same outcome.

In the latter type of scratch-off or pull tab game, the user typically removes the covering from a subset of the indicia disposed on the lottery ticket, and the user wins if the user selected a predetermined winning subset of the indicia. For example, the indicia on the lottery ticket may represent different dollar amounts that may be awarded for winning numbers with three of the dollar amounts being the same, and the three remaining dollar amounts being different. To play the game, the user may select and remove the covering from three of the dollar amounts. If the user exposes the three matching dollar amounts, the user wins the corresponding prize amount. If the user exposes one or more of the non-matching dollar amounts, the user does not win a prize for that lottery ticket. Consequently, each ticket may potentially be a winning ticket, but the ticket will only be a winning ticket if the user selects and uncovers the winning combination of indicia.

While step 904 is discussed with reference to specific lottery game examples, it is to be understood that different versions of these lottery games or other lottery games are deemed to be part of this invention.

The method may continue by the lottery server 116 comparing the winning result(s) against accepted lottery game entries to determine a set of winning lottery game entries (step 908) and selecting winning lottery game entries (step 912). Upon completion of the lottery game, the lottery game entries may be redeemed by the users and the winning entries determined. For the lottery games for which a drawing is conducted with the outcome of the drawing being compared to each of the user's entries to determine whether the entries are winning entries, the results of the drawing may be entered via a lottery game entry acceptance device 344 of a lottery terminal unit 112 and recorded by the lottery server 116. In implementations where the lottery game entries are stored in a database, such as the lottery game entry database 154, and/or at the lottery terminal units 112, the lottery game entries for the occurrence of the lottery game may be compared to the outcome of the lottery game to determine which lottery game entries are winning entries. Based on the results of the comparison, the lottery server 116 may generate a listing of winning entries for the occurrence of the lottery game.

When a user presents a lottery game entry at a sales agent location for redemption, the lottery game entry, such as a physical lottery ticket, may be inserted in the lottery game entry acceptance device 344 of a lottery terminal unit 112. The lottery terminal unit 112 may use the information encoded on the lottery game entry (e.g., the lottery game entry identifier) to retrieve information (e.g., the sequence of numbers or other characters generated for the lottery game entry in the entry identifier field 504 (FIG. 5A)), via the lottery server 116, from the lottery game entry database 154 to determine whether the lottery game entry is a winning lottery game entry. Alternatively, where the user's selections are encoded on the lottery game entry, the lottery terminal unit 112 or lottery server 116 may compare the user's selections to the drawing outcome to determine whether the lottery game entry is a winning lottery game entry, and determine the corresponding award amount. Still further, the lottery game entry, and in particular a scratch-off and pull tab ticket or Bingo card, may be evaluated by a sales agent to determine whether the lottery ticket is a winning ticket, and any corresponding prize award. The sales agent can then provide the information, via a lottery terminal unit 112, to the lottery server 116.

The method may continue by the lottery server 116 determining an outcome modifier for each of the winning lottery game entries (step 916). The current outcome modifiers for each winning lottery game entry can be determined using the lottery game entry identifier (contained in entry field 504 of FIG. 5A) and/or the user identity (contained in the user information field 512 of FIG. 5A) to obtain the current outcome modifier in the corresponding outcome modifier(s) field 528 (FIG. 5A). This information can be inputted by the user or a sales agent into a lottery terminal unit 112.

The method may continue by the lottery server 116 applying the outcome modifier to each winning lottery entry amount of each winning lottery game entry to determine a corresponding user's share of the jackpot (step 920) and updating electronic records in the lottery game and lottery game entry databases 150 and 154 (step 924). The lottery server 116 typically updates, for each winning lottery entry, the award information field 536 (FIG. 5A) and winning result field 564 (FIG. 5B).

The method may continue by the lottery server 116 comparing the user jackpot share(s) or wining results for the winning lottery game entries against the return to user amount (step 928) and determining whether or not there is a difference (step 932). As noted, the lottery server 116 compares the values in the winning result field 564 and RTP amount field 562 in FIG. 5B.

When the values match, the lottery server notifies the users of the winning lottery game entries of their respective awards (step 940). This can be done by the lottery server 116 sending a notification to a lottery terminal unit 112, gaming machine 118, and/or portable gaming device 128 associated with each user. For example, the lottery server 116 can generate one or more messages that identify the winning lottery number(s), the user(s) 124 to which the winning numbers were assigned, and destination addresses for communicating with the winning user(s) 124. The message generated at the lottery server 116 may then be sent to the determined destination addresses, which may correspond to addresses of a portable gaming device 128, a gaming machine 118, other gaming device, or a combination thereof. Alternatively or additionally, the destination addresses may correspond to email addresses, phone numbers (for a phone call or text message), a web address, a social media identifier, etc.

When there is a difference, the lottery game server 116 increments the value in the secondary award pool field 568 of FIG. 5B by the difference(s) and updates the value accordingly (step 936).

The method may continue by the lottery server 116 determining the lottery game entries receiving a share of the secondary award pool and the share amounts (step 942) and therefore notifying users of the shares (step 940). This can be done in any number of ways. Separate criteria can be specified for winning the funds in the secondary award pool, such as specified requirements for a second set of user inputs from a further secondary game of knowledge, skill, random chance, pseudo skill or chance, or a combination thereof. For instance, the secondary game can be a purely random event that occurs after each ticket is graded, a hybrid chance and skill-based event such as answering all questions correctly for a random chance to win the secondary award pool, or a purely skill-based event such as answering 10 consecutive questions correctly. Alternatively, the secondary award pool can be allocated to the winning lottery game entries on a pro-rata basis or based on the relative sizes of the values in the respective award information field 536 (FIG. 5A). However the secondary award pool is disbursed, the lottery game server 116 may proceed to step 940 and notify the users of winning lottery game entries of their respective prize awards.

Once the prize award for the lottery game entry is determined and the associated users notified, the value of the award may be dispensed to the user corresponding to the prize amount. The dispensed value may be in any appropriate form, including direct cash payments by the sales agent to the users, printing and issuance of a credit voucher or check at the lottery terminal unit 112, applying credit to a debit card, credit card, smart card, user's lottery or bank account, or any other mechanism for dispensing value to the user.

As each payment is disbursed to each user, the lottery game server 116 can update the game information field 558 of FIG. 5B and award field 536 of FIG. 5B to note that funds have been disbursed in full to the user associated with the corresponding lottery game entry.

While the above embodiments are discussed with reference to the use of one or more user secondary game inputs to adjust a winning user's share of a lottery jackpot in a primary lottery game, it is to be appreciated that the methods are equally applicable to adjusting generally the expected value of the user's lottery game entry, which envisions not only increasing or decreasing a winning user's share of a lottery jackpot in the primary lottery game but also increasing or decreasing a probability of having a winning outcome in the lottery game or both.

While the above methods are discussed with reference to determining the outcome modifier before winning lottery game entry redemption, it is to be appreciated that the outcome modifier can be determined at the time of redemption.

Certain of the gaming systems described herein can include certain components and/or are configured to operate in certain manners that differentiate these gaming devices and systems from general purpose computing devices (i.e., certain personal gaming devices such as desktop computers and laptop computers).

For instance, gaming devices are highly regulated to ensure fairness and, in many cases, gaming devices, such as lottery terminal units 112 and gaming machines, are configured to award monetary awards up to multiple millions of dollars. To satisfy security and regulatory requirements in a gaming environment, hardware and/or software architectures are implemented in gaming devices that differ significantly from those of general-purpose computing devices. For purposes of illustration, a description of gaming devices relative to general-purpose computing devices and some examples of these additional (or different) hardware and/or software architectures found in gaming devices are described herein.

At first glance, one might think that adapting general-purpose computing device technologies to the gaming industry and gaming devices would be a simple proposition because both general purpose computing devices and gaming devices employ processors that control a variety of devices. However, due to at least: (1) the regulatory requirements placed on gaming devices, (2) the harsh environment in which gaming devices operate, (3) security requirements, and (4) fault tolerance requirements, adapting general purpose computing device technologies to gaming devices can be quite difficult. Further, techniques and methods for solving a problem in the general-purpose computing device industry, such as device compatibility and connectivity issues, might not be adequate in the gaming industry. For instance, a fault or a weakness tolerated in a general-purpose computing device, such as security holes in software or frequent crashes, is not tolerated in a gaming device because in a gaming device these faults can lead to a direct loss of funds from the gaming device, such as stolen cash or loss of revenue when the gaming device is not operating properly or when the random outcome determination is manipulated.

Certain differences between general-purpose computing devices and gaming devices are described below. A first difference between gaming devices and general-purpose computing devices is that gaming devices are state-based systems. A state-based system stores and maintains its current state in a non-volatile memory such that, in the event of a power failure or other malfunction, the state-based system can return to that state when the power is restored or the malfunction is remedied. For instance, for a state-based gaming device, if the gaming device displays an award for a game of chance but the power to the gaming device fails before the gaming device provides the award to the user, the gaming device stores the pre-power failure state in a non-volatile memory, returns to that state upon restoration of power, and provides the award to the user. This requirement affects the software and hardware design on gaming devices. General-purpose computing devices are typically not state-based machines, and a majority of data can be lost when a malfunction occurs on a general-purpose computing device.

A second difference between gaming devices and general-purpose computing devices is that, for regulatory purposes, the software on the gaming device utilized to operate the gaming device has been designed to be static and monolithic to prevent cheating by the operator of the gaming device. For instance, one solution that has been employed in the gaming industry to prevent cheating and to satisfy regulatory requirements has been to manufacture a gaming device that can use a proprietary processor running instructions to provide the game of chance from an EPROM or other form of non-volatile memory. The coding instructions on the EPROM are static (non-changeable) and must be approved by a gaming regulator in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the gaming device in the presence of a gaming regulator. Regardless of whether the EPROM solution is used, to gain approval in most gaming jurisdictions, a gaming device must demonstrate sufficient safeguards that prevent an operator or a user of a gaming device from manipulating the gaming device's hardware and software in a manner that gives him an unfair, and in some cases illegal, advantage.

A third difference between gaming devices and general-purpose computing devices is authentication-gaming devices storing code are configured to authenticate the code to determine if the code is unaltered before executing the code. If the code has been altered, the gaming device prevents the code from being executed. The code authentication requirements in the gaming industry affect both hardware and software designs on gaming devices. Certain gaming devices use hash functions to authenticate code. For instance, one gaming device stores game program code, a hash function, and an authentication hash (which may be encrypted). Before executing the game program code, the gaming device hashes the game program code using the hash function to obtain a result hash and compares the result hash to the authentication hash. If the result hash matches the authentication hash, the gaming device determines that the game program code is valid and executes the game program code. If the result hash does not match the authentication hash, the gaming device determines that the game program code has been altered (i.e., may have been tampered with) and prevents execution of the game program code. Examples of gaming device code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes," which are incorporated herein by reference.

A fourth difference between gaming devices and general-purpose computing devices is that gaming devices have unique peripheral device requirements that differ from those of a general-purpose computing device, such as peripheral device security requirements not usually addressed by general-purpose computing devices. For instance, monetary devices, such as coin dispensers, bill validators, and ticket printers and computing devices that are used to govern the input and output of cash or other items having monetary value (such as tickets) to and from a gaming device have security requirements that are not typically addressed in general purpose computing devices. Therefore, many genera-purpose computing device techniques and methods developed to facilitate device connectivity and device compatibility do not address the emphasis placed on security in the gaming industry.

To address some of the issues described above, a number of hardware/software components and architectures are utilized in gaming devices that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain gaming devices use a watchdog timer to provide a software failure detection mechanism. In a normally-operating gaming device, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain gaming devices use several power supply voltages to operate portions of the computer circuitry. These can be generated in a central power supply or locally on the computer board. If any of these voltages falls out of the tolerance limits of the circuitry they power, unpredictable operation of the gaming device may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain gaming devices have power supplies with relatively tighter voltage margins than that required by the operating circuitry. In addition, the voltage monitoring circuitry implemented in certain gaming devices typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the gaming device.

As described above, certain gaming devices are state-based machines. Different functions of the game provided by the gaming device (e.g., bet, play, result, points in the graphical presentation, etc.) may be defined as a state. When the gaming device moves a game from one state to another, the gaming device stores critical data regarding the game software in a custom non-volatile memory subsystem. This ensures that the user's wager and credits are preserved and to minimize potential disputes in the event of a malfunction on the gaming device. In general, the gaming device does not advance from a first state to a second state until critical information that enables the first state to be reconstructed has been stored. This feature enables the gaming device to recover operation to the current state of play in the event of a malfunction, loss of power, etc. that occurred just prior to the malfunction. In at least one embodiment, the gaming device is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the gaming device memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve gaming device critical data, although other types of non-volatile memory devices may be employed. These memory devices are typically not used in typical general purpose computing devices.

Thus, in at least one embodiment, the gaming device is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of gaming device critical information) within a time period of 200 milliseconds or less. In at least one embodiment, the time period of 200 milliseconds represents a maximum amount of time for which sufficient power may be available to the various gaming device components after a power outage event has occurred at the gaming device.

As described previously, the gaming device may not advance from a first state to a second state until critical information that enables the first state to be reconstructed has been atomically stored. After the state of the gaming device is restored during the play of a game of chance, game play may resume and the game may be completed in a manner that is no different than if the malfunction had not occurred. Thus, for example, when a malfunction occurs during a game of chance, the gaming device may be restored to a state in the game of chance just prior to when the malfunction occurred. The restored state may include metering information and graphical information that was displayed on the gaming device in the state prior to the malfunction. For example, when the malfunction occurs during the play of a card game after the cards have been dealt, the gaming device may be restored with the cards that were previously displayed as part of the card game. As another example, a bonus game may be triggered during the play of a game of chance in which a user is required to make a number of selections on a video display screen. When a malfunction has occurred after the user has made one or more selections, the gaming device may be restored to a state that shows the graphical presentation just prior to the malfunction including an indication of selections that have already been made by the user. In general, the gaming device may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the gaming device and the state of the gaming device (e.g., credits) at the time the game of chance was played. The game history information may be utilized in the event of a dispute. For example, a user may decide that in a previous game of chance that they did not receive credit for an award that they believed they won. The game history information may be used to reconstruct the state of the gaming device prior to, during, and/or after the disputed game to demonstrate whether the user was correct or not in her assertion. Examples of a state-based gaming device, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play," which are incorporated herein by reference.

Another feature of gaming devices is that they often include unique interfaces, including serial interfaces, to connect to specific subsystems internal and external to the gaming device. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the gaming device, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between gaming devices. As another example, SAS is a communication protocol used to transmit information, such as metering information, from an gaming device to a remote device. Often SAS is used in conjunction with a user tracking system.

Certain gaming devices may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an gaming device by monitoring security switches attached to access doors in the gaming device cabinet. Access violations result in suspension of game play and can trigger additional security operations to preserve the current state of game play. These circuits also function when power is off by use of a battery backup. In power-off operation, these circuits continue to monitor the access doors of the gaming device. When power is restored, the gaming device can determine whether any security violations occurred while power was off, e.g., via software for reading status registers. This can trigger event log entries and further data authentication operations by the gaming device software.

Trusted memory devices and/or trusted memory sources are included in an gaming device to ensure the authenticity of the software that may be stored on less secure memory subsystems, such as mass storage devices. Trusted memory devices and controlling circuitry are typically designed to not enable modification of the code and data stored in the memory device while the memory device is installed in the gaming device. The code and data stored in these devices may include authentication algorithms, random number generators, authentication keys, operating system kernels, etc. The purpose of these trusted memory devices is to provide gaming regulatory authorities a root trusted authority within the computing environment of the gaming device that can be tracked and verified as original. This may be accomplished via removal of the trusted memory device from the gaming device computer and verification of the secure memory device contents is a separate third party verification device. Once the trusted memory device is verified as authentic, and based on the approval of the verification algorithms included in the trusted device, the gaming device is enabled to verify the authenticity of additional code and data that may be located in the gaming computer assembly, such as code and data stored on hard disk drives. Examples of trusted memory devices are described in U.S. Pat. No. 6,685,567, entitled "Process Verification," which is incorporated herein by reference.

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

Gaming devices storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment," which is incorporated herein by reference.

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, gaming devices that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System," which is incorporated herein by reference.

It should further be appreciated that the gaming device of the present disclosure may have varying or alternative housing configurations.

It should further be appreciated that the gaming device of the present disclosure may have varying or alternative display configurations.

In various embodiments, the gaming device of the present disclosure is configured to be positioned on a base or stand.

It should be appreciated that the enhanced physical user interaction provided by the present disclosure, in addition to being implemented in a gaming device configured to be located on a casino floor or in a public forum, can be implemented in one or more personal gaming devices, such as desktop computers, laptop computers, tablet computers or computing devices, personal digital assistants, mobile phones, and other mobile computing devices.

The present disclosure contemplates a variety of different gaming systems each having one or more of a plurality of different features, attributes, or characteristics. A "gaming system" as used herein refers to various configurations of:

(a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices. Moreover, a gaming machine as used herein refers to any suitable electronic gaming machine which enables a user to play a game (including but not limited to a game of chance, a game of skill, and/or a game of partial skill) to potentially win one or more awards, wherein the gaming machine comprises, but is not limited to: a slot machine, a video poker machine, a video lottery terminal, a terminal associated with an electronic table game, a video keno machine, a video bingo machine located on a casino floor, a sports betting terminal, or a kiosk.

In various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, "gaming machine" as used herein represents one gaming machine or a plurality of gaming machines, "personal gaming device" as used herein represents one personal gaming device or a plurality of personal gaming devices, and "central server, central controller, or remote host" as used herein represents one central server, central controller, or remote host or a plurality of central servers, central controllers, or remote hosts. A "gaming device" as used herein may be understood to include a gaming machine, multiple gaming machines, a lottery terminal unit, multiple lottery terminal units, a personal gaming device, multiple personal gaming devices, a portable gaming device, multiple portable gaming devices, or combinations thereof.

As noted above, in various embodiments, the gaming system includes a gaming device in combination with a central server, central controller, or remote host. In such embodiments, the gaming machine (or gaming device) is configured to communicate with the central server, central controller, or remote host through a data network or remote communication link. In certain such embodiments, the gaming machine (or gaming device) is configured to communicate with another gaming machine (or gaming device) through the same data network or remote communication link or through a different data network or remote communication link. For example, the gaming system includes a plurality of gaming devices that are each configured to communicate with a central server, central controller, or remote host through a data network.

In certain embodiments in which the gaming system includes a gaming device in combination with a central server, central controller, or remote host, the central server, central controller, or remote host is any suitable computing device (such as a server) that includes at least one processor and at least one memory device or data storage device. As further described herein, the gaming machine (or gaming device) includes at least one gaming machine (or gaming device) processor configured to transmit and receive data or signals representing events, messages, commands, or any other suitable information between the gaming machine (or gaming device) and the central server, central controller, or remote host. The at least one processor of that gaming machine (or gaming device) is configured to execute the events, messages, or commands represented by such data or signals in conjunction with the operation of the gaming machine (or gaming device). Moreover, the at least one processor of the central server, central controller, or remote host is configured to transmit and receive data or signals representing events, messages, commands, or any other suitable information between the central server, central controller, or remote host and the gaming machine (or gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the gaming machine (or gaming device). Further, one, more than one, or each of the functions of the at least one processor of the gaming machine (or gaming device) may be performed by the at least one processor of the central server, central controller, or remote host.

In certain such embodiments, computerized instructions for controlling any games (such as any primary or base games and/or any secondary or bonus games) displayed by the gaming machine (or gaming device) are executed by the central server, central controller, or remote host. In such "thin client" embodiments, the central server, central controller, or remote host remotely controls any games (or other suitable interfaces) displayed by the gaming machine (or gaming device), and the gaming machine (or gaming device) is utilized to display such games (or suitable interfaces) and to receive one or more inputs or commands. In other such embodiments, computerized instructions for controlling any games displayed by the gaming machine (or gaming device) are communicated from the central server, central controller, or remote host to the gaming machine (or gaming device) and are stored in at least one memory device of the gaming machine (or gaming device). In such "thick client" embodiments, the at least one processor of the gaming machine (or gaming device) executes the computerized instructions to control any games (or other suitable interfaces) displayed by the gaming machine (or gaming device).

In various embodiments in which the gaming system includes a plurality of gaming machines (or gaming devices), one or more of the gaming machines (or gaming devices) are thin client gaming machines (or gaming devices) and one or more of the gaming machines (or gaming devices) are thick client gaming machines (or gaming devices). In other embodiments in which the gaming system includes one or more gaming machines (or gaming devices), certain functions of one or more of the gaming machines (or gaming devices) are implemented in a thin client environment, and certain other functions of one or more of the gaming machines (or gaming devices) are implemented in a thick client environment. In one such embodiment in which the gaming system includes an gaming machine (or gaming device) and a central server, central controller, or remote host, computerized instructions for controlling any primary or base games displayed by the gaming machine (or gaming device) are communicated from the central server, central controller, or remote host to the gaming machine (or gaming device) in a thick client configuration, and computerized instructions for controlling any secondary or bonus games or other functions displayed by the gaming machine (or gaming device) are executed by the central server, central controller, or remote host in a thin client configuration.

In certain embodiments in which the gaming system includes: (a) a gaming machine (or gaming device) configured to communicate with a central server, central controller, or remote host through a data network; and/or (b) a plurality of gaming machines (or gaming devices) configured to communicate with one another through a communication network, the communication network may include a local area network (LAN) in which the gaming machines (or gaming devices) are located substantially proximate to one another and/or the central server, central controller, or remote host. In one example, the gaming machines (or gaming devices) and the central server, central controller, or remote host are located in a gaming establishment or a portion of a gaming establishment.

In other embodiments in which the gaming system includes: (a) a gaming machine (or gaming device) configured to communicate with a central server, central controller, or remote host through a data network; and/or (b) a plurality of gaming machines (or gaming devices) configured to communicate with one another through a communication network, the communication network may include a wide area network (WAN) in which one or more of the gaming machines (or gaming devices) are not necessarily located substantially proximate to another one of the gaming machines (or gaming devices) and/or the central server, central controller, or remote host. For example, one or more of the gaming machines (or gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the gaming machines (or gaming devices) are located. In certain embodiments in which the communication network includes a WAN, the gaming system includes a central server, central controller, or remote host and an gaming machine (or gaming device) each located in a different gaming establishment in a same geographic area, such as a same city or a same state. Gaming systems in which the communication network includes a WAN are substantially identical to gaming systems in which the communication network includes a LAN, though the quantity of gaming machines (or gaming devices) in such gaming systems may vary relative to one another.

In further embodiments in which the gaming system includes: (a) a gaming machine (or gaming device) configured to communicate with a central server, central controller, or remote host through a data network; and/or (b) a plurality of gaming machines (or gaming devices) configured to communicate with one another through a communication network, the communication network may include an internet (such as the Internet) or an intranet. In certain such embodiments, an Internet browser of the gaming machine (or gaming device) is usable to access an Internet game page from any location where an Internet connection is available. In one such embodiment, after the gaming machine (or gaming device) accesses the Internet game page, the central server, central controller, or remote host identifies a user before enabling that user to place any wagers on any plays of any wagering games. In one example, the central server, central controller, or remote host identifies the user by requiring a user account of the user to be logged into via an input of a unique user name and password combination assigned to the user. The central server, central controller, or remote host may, however, identify the user in any other suitable manner, such as by validating a user tracking identification number associated with the user; by reading a user tracking card or other smart card inserted into a card reader; by validating a unique user identification number associated with the user by the central server, central controller, or remote host; or by identifying the gaming machine (or gaming device), such as by identifying the MAC address or the IP address of the Internet facilitator. In various embodiments, once the central server, central controller, or remote host identifies the user, the central server, central controller, or remote host enables placement of one or more wagers on one or more plays of one or more primary or base games and/or one or more secondary or bonus games, and displays those plays via the Internet browser of the gaming machine (or gaming device). Examples of implementations of Internet-based gaming are further described in U.S. Pat. No. 8,764,566, entitled "Internet Remote Game Server," and U.S. Pat. No. 8,147,334, entitled "Universal Game Server".

The central server, central controller, or remote host and the gaming machine (or gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for users to use a variety of gaming machines (or gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with users.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

What is claimed is:

1. A lottery gaming system, comprising:

a communications interface that enables communications with a gaming device of a first user;

a processor coupled to the communications interface; and a computer-readable storage memory coupled with the processor and comprising instructions that are executable by the processor, wherein the instructions comprise instructions to:

receive, by the communications interface from the gaming device of the first user, a unique identifier of a lottery game entry in a lottery game, the unique identifier being different than a unique identifier of the first user stored in the computer-readable storage memory;

determine, from the unique identifier of the lottery game entry and the unique identifier of the first user, that the first user is associated with the lottery game entry;

send, to the gaming device of the first user, an authorization message to collect an input of the first user from a secondary game;

receive, by the communications interface, an input of the first user from the secondary game, the input being an outcome of the secondary game;

in response to receipt of the input, determine an outcome modifier that adjusts an expected value of the lottery game entry, wherein the outcome modifier adjusts a magnitude of a winning lottery amount to be paid to the first user when the lottery game entry corresponds to a winning result; and update, in the computer-readable storage memory, an outcome modifier value stored in an electronic record associated with the unique identifier of the lottery game entry.

2. The lottery gaming system of claim 1, wherein the unique identifier comprises a Quick Response (QR) code, wherein the input comprises one or more of a secondary game outcome and a proficiency level measure of the first user, wherein the outcome modifier for the first user is different from an outcome modifier for a second user having a second lottery game entry in the lottery game and wherein the instructions further comprise instructions to:

determine that the first user is eligible to play an instance of a secondary game different from the lottery game prior to sending the authorization message;

accept the lottery game entry from the first user;

determine the winning result for the lottery game;

compare the accepted lottery game entry against the winning result to determine that the accepted lottery game entry corresponds to the winning result;

apply, in response to determining that the accepted lottery game entry corresponds to the winning result, the outcome modifier to the winning lottery amount to determine an adjusted winning lottery amount to make to the first user, wherein the winning result is determined after determination of the outcome modifier; and update an electronic record associated with the unique identifier of the lottery game entry to reflect payout of the adjusted winning lottery amount.

3. The lottery gaming system of claim 1, wherein the winning lottery amount and adjusted winning lottery amount correspond to a lottery jackpot, wherein the input is a skill-based input generated from an outcome of a game of skill, wherein the first user plays the game of skill via an application on the gaming device, and wherein the instructions further comprise instructions to:

receive, at the communications interface, a scanned digital image of a lottery ticket corresponding to the lottery game entry;

receive a second input of the first user;

determine, in response to receipt of the second input, a second outcome modifier that adjusts the winning lottery amount when the lottery game entry is the winning result;

compare the outcome modifier against the second outcome modifier;

adjust the winning lottery amount by a larger of the outcome modifier and second outcome modifier; and update an electronic record associated with the lottery ticket to reflect payout of the adjusted winning lottery amount.

4. The lottery gaming system of claim 1, wherein the input is a chance-based input generated from an outcome of a game of chance, and wherein the instructions further comprise instructions to:

receive, at the communications interface, a digital representation of a lottery ticket corresponding to the lottery game entry;

receive a second input for a second user, the first user and second user being members of a user group, each member of the user group being associated with different lottery game entries;

determine, in response to receiving the second input, a second outcome modifier that adjusts a winning lottery amount when the lottery game entry is a winning result;

compare the outcome modifier against the second outcome modifier; and adjust the winning lottery amount for each member of the user group by a larger of the outcome modifier and second outcome modifier and further comprising:

generate the winning result of the lottery game by a first random number generator different from the first random number generator; and comparing the winning result with the unique identifier to determine whether the lottery game entry corresponds to the winning result, wherein the outcome modifier is determined by a second random number generator different from the first random number generator.

5. The lottery gaming system of claim 1, wherein the input of the first user comprises a challenge-based input based on knowledge of the first user, wherein the challenge-based input comprises an award of a prize, and wherein the instructions further comprise instructions to:

receive, at the communications interface, a second input for a second user, the first user and second user being associated with different lottery game entries;

compare, in response to receiving the second input, the input of the first user with the second input of the second user to determine outcome modifiers of each of the first user and the second user; and update an electronic record associated with an identifier of the lottery game entry of the first user and a second identifier of a lottery game entry of the second user to reflect the determined outcome modifiers of each of the first user and the second user, wherein the determined outcome modifiers of the first and second users are different from each other.

6. The lottery gaming system of claim 1, wherein the gaming device comprises an electronic gaming machine, virtual gaming machine, video game gambling machine, video lottery terminal, electronic table game, or personal computing device and wherein the instructions further comprise instructions to:

determine a winning result for the lottery game;

compare the lottery game entry against the winning result to determine when the lottery game entry corresponds to the winning result;

apply, when the lottery game entry corresponds to the winning result, the outcome modifier to the winning lottery amount to determine a payout for the first user;

compare the payout for the first user against a Return to Player (RTP) amount for the lottery game;

determine a difference between the payout for the first user and the RTP amount; and update, when the payout for the first user is less than the RTP amount, an electronic record associated with a separate secondary award pool to reflect the difference, wherein the separate secondary award pool is further distributed among one or more users associated with different lottery game entries in the lottery game.

7. The lottery gaming system of claim 1, wherein the outcome modifier does not adjust a probability of the lottery game entry being associated with a winning lottery outcome, wherein a plurality of outcome modifiers correspond to a plurality of user levels, and wherein the instructions further comprise instructions to:

adjust a lottery modifier counter;

compare the adjusted lottery modifier counter with a maximum counter value to determine whether the first user is eligible to receive a second outcome modifier;

determine, when the first user is eligible to receive the second outcome modifier, a user level of the first user;

select, based on the determined user level, the second outcome modifier from among the plurality of outcome modifiers; and store the second outcome modifier in association with the unique identifier of the lottery game entry;

receive, at the communications interface, a request from the first user to transfer the second outcome modifier to a second lottery game entry of the first user in the lottery game; and update an electronic record associated with respective unique identifiers of the lottery game entry and second lottery game entries of the first user to reflect the transfer of the second outcome modifier from the lottery game entry to the second lottery game entry.

8. A method, comprising:

receiving, at a communications interface of a lottery server and from a gaming device of a first user, a unique identifier of a lottery game entry in a lottery game, the unique identifier being different than a stored unique identifier of the first user;

determining, at the lottery server and from the unique identifier of the lottery game entry and the unique identifier of the first user, that the first user is associated with the lottery game entry;

determining, at the lottery server, that the first user is eligible to play an instance of a secondary game different from the lottery game;

sending, by the communications interface of the lottery server to the gaming device, an authorization message to collect an input of the first user from the secondary game;

receiving, at the communications interface of the lottery server and from the gaming device, the input of the first user from play of the secondary game, the input being an outcome of the secondary game;

in response to receiving the input, determining, at the lottery server, an outcome modifier that adjusts an expected value of the lottery game entry, wherein the outcome modifier adjusts a magnitude of a winning lottery amount to be paid to the first user when the lottery game entry corresponds to a winning result;

generating, by a random number generator, the winning result of the lottery game; and comparing the unique identifier with the winning result to determine whether the lottery game entry corresponds to the winning result.

9. The method of claim 8, wherein the unique identifier comprises a Quick Response (QR) code, wherein the unique identifier comprises a Quick Response (QR) code, wherein the input comprises one or more of a secondary game outcome and a proficiency level measure of the first user, wherein the outcome modifier for the first user is different from an outcome modifier for a second user having a second lottery game entry in the lottery game, and further comprising:

accepting, at the communications interface of the lottery server, the lottery game entry from the first user;

receiving a request to move the input of the first user from a first electronic record associated with the accepted lottery game entry to a second electronic record associated with a second lottery game, the accepted and second lottery game entries being associated with the first user;

updating the second electronic record associated with the second lottery game entry to replace a prior input of the first user with the moved first user input;

determining, at the lottery server, the winning result for the lottery game;

comparing, at the lottery server, the second user's lottery game entry against the winning result to determine that the second user's lottery game entry corresponds to the winning result;

in response to the second user's lottery game entry corresponding to the winning result, applying, at the lottery server, the outcome modifier to the winning lottery amount to determine an adjusted winning lottery amount; and updating the second electronic record associated with the first user to reflect the adjusted winning lottery amount.

10. The method of claim 8, wherein the winning lottery amount and adjusted winning lottery amount correspond to a lottery jackpot, wherein the input of the first user comprises a skill-based input, wherein the skill-based input is generated from an outcome of a game of skill, wherein the first user plays the game of skill via an application on a gaming device, and further comprising:

receiving, at the communications interface of the lottery server, a scanned digital image of a lottery ticket corresponding to the lottery game entry;

receiving, at the lottery server, a second input of the first user;

in response to receiving the second input, determining, at the lottery server, a second outcome modifier that adjusts a winning lottery amount when the lottery game entry is the winning result;

comparing, at the lottery server, the outcome modifier against the second outcome modifier;

adjusting, at the lottery server, the winning lottery amount by a larger of the outcome modifier and second outcome modifier; and updating an electronic record associated with the lottery ticket to reflect the adjusted winning lottery amount.

11. The method of claim 8, wherein the input is a chance-based input generated from an outcome of a game of chance, wherein the outcome modifier is determined by a second random number generator different from the random number generator of the lottery server, and further comprising:

receive, at the communications interface of the lottery server, a digital representation of a lottery ticket corresponding to the lottery game entry;

receiving, at the lottery server, a second input for a second user, the first user and second user being members of a user group, each member of the user group being associated with different lottery game entries;

in response to receiving the second input, determining, at the lottery server, a second outcome modifier that adjusts a winning lottery amount when the lottery game entry is a winning result;

comparing, at the lottery server, the outcome modifier against the second outcome modifier; and adjusting, at the lottery server, the winning lottery amount for each member of the user group by a larger of the outcome modifier and second outcome modifier.

12. The method of claim 8, wherein the input of the first user comprises a challenge-based input based on knowledge of the first user, wherein the challenge-based input comprises an occurrence of a game event, and further comprising:

receiving, at the communications interface of the lottery server, a second input for a second user, the first user and second user being associated with different lottery game entries;

in response to receiving the second input, comparing, at the lottery server, the input of the first user with the second input of the second user to determine outcome modifiers of each of the first user and the second user; and updating an electronic record associated with the unique identifier of the lottery game entry of the first user and an identifier of a lottery game entry of the second user to reflect the determined outcome modifiers of each of the first user and the second user, wherein the determined outcome modifiers of the first and second users are different from each other.

13. The method of claim 8, wherein the gaming device comprises an electronic gaming machine, virtual gaming machine, video game gambling machine, video lottery terminal, electronic table game, or personal computing device and further comprising:

determining, at the lottery server, a winning result for the lottery game;

comparing, at the lottery server, the lottery game entry against the winning result to determine if the lottery game entry corresponds to the winning result;

when the lottery game entry corresponds to the winning result, applying, at the lottery server, the outcome modifier to the winning lottery amount to determine a payout for the first user;

comparing, at the lottery server, the payout for the first user against a Return to User (RTP) amount for the lottery game;

determining, at the lottery server, a difference between the payout for the first user and the RTP amount; and when the payout for the first user is less than the RTP amount, updating, at the lottery server, an electronic record associated with a separate secondary award pool to reflect the difference, wherein the separate secondary award pool is further distributed among one or more users associated with different lottery game entries in the lottery game.

14. The method of claim 8, wherein the outcome modifier does not adjust a probability of the lottery game entry being associated with a winning lottery outcome, wherein a plurality of outcome modifiers correspond to a plurality of user levels, and further comprising:

adjusting, at the lottery server, a lottery modifier counter; and comparing, at the lottery server, the adjusted lottery modifier counter with a maximum counter value to determine whether the first user is eligible to receive a second outcome modifier;

determining, when the first user is eligible to receive the second outcome modifier, a user level of the first user;

determining, based on the determined user level, the second outcome modifier from among the plurality of outcome modifiers; and storing, at the lottery server, the second outcome modifier in association with the unique identifier of the lottery game entry;

receiving, at the communications interface of the lottery server, a request from the first user to transfer the second outcome modifier to a second lottery game entry of the first user in the lottery game; and updating an electronic record associated with a respective unique identifiers of the lottery game entry and second lottery game entries of the first user to reflect the transfer of the second outcome modifier from the lottery game entry to the second lottery game entry.

15. A gaming device, comprising:

a display;

a communications interface that facilitates machine-to-machine communications via a communication network;

a processor coupled to the display and the communications interface;

a random number generator to output a random number and/or symbol for use in a secondary game, the secondary game being different than a lottery game; and a computer memory coupled with the processor, the computer memory comprising processor-executable instructions that, when executed by the processor, cause the processor to:

receive, via the communications interface, a unique identifier of a lottery game entry in a lottery game, the lottery game entry being associated with a first user and the unique identifier being different than a stored unique identifier of the first user;

provide, via the communications interface, to a lottery server the unique identifier of the lottery game entry;

receive, via the communications interface from the lottery server, permission to collect a user input from gameplay of the secondary game;

execute the secondary game using the output from the random number generator and render the secondary game on the display;

receive, via the secondary game, an input of the first user, the input being related to a result of the secondary game;

receive, via the communications interface, an outcome modifier from the lottery server, the outcome modifier being related to the input and adjusting an expected value of the lottery game entry, wherein the outcome modifier adjusts a magnitude of a winning lottery amount to be paid to the first user when the lottery game entry corresponds to a winning result; and render the outcome modifier on the display.

16. The gaming device of claim 15, wherein the unique identifier comprises a Quick Response (QR) code, wherein the outcome modifier for the first user is different from an outcome modifier for a second user having a second lottery game entry in the lottery game wherein, when an accepted user lottery game entry corresponds to a winning result, the processor renders, via the display, the adjusted winning lottery amount, and wherein the adjusted winning lottery amount comprises a product of the outcome modifier and the winning lottery amount.

17. The gaming device of claim 15, wherein the winning lottery amount and adjusted winning lottery amount correspond to a lottery jackpot, wherein the input of the first user comprises a skill-based input, wherein the rendered secondary game comprises a game of skill, wherein the skill-based input is generated from an outcome of the game of skill, wherein the first user plays the game of skill via an application, and wherein the processor further:

provides to the lottery server a scanned digital image of a lottery ticket corresponding to the lottery game entry;

renders a second secondary game on the display;

receives, via the display, a second input of the first user, the second input being related to a result of the second secondary game;

provides, via the communications interface, the second input to the lottery server;

in response, receives, via the communications interface, a second outcome modifier from the lottery server, the second outcome modifier being related to the second input and increasing a winning lottery amount when the lottery game entry is a winning result, wherein the outcome modifier is less than the second outcome modifier; and renders the second outcome modifier on the display.

18. The gaming device of claim 15, wherein the outcome modifier does not adjust a probability of the lottery game entry corresponding to a winning result, wherein the input of the first user comprises a chance-based input, wherein the rendered secondary game comprises a game of chance, wherein the chance-based input is generated from an outcome of the game of chance, wherein the first user plays the game of chance via an application, and wherein the processor further:

receives, from the lottery server, a digital representation of a lottery ticket corresponding to the lottery game entry;

receives, via the communications interface, a second outcome modifier from the lottery server, the second outcome modifier being related to a second input received from a different second user being associated with a second different lottery game entry, wherein the outcome modifier is less than the second outcome modifier; and renders the second outcome modifier on the display.

19. The gaming device of claim 15, wherein the outcome modifier is determined by a first random number generator, wherein the winning result of the lottery game is determined by a second random number generator different from the first random number generator, wherein the gaming device comprises an electronic gaming machine, virtual gaming machine, video game gambling machine, video lottery terminal, electronic table game, or personal computing device and wherein the processor further:

provides a request to the lottery server for permission to render a further secondary game to the first user; and receives, from the lottery server, permission to render the further secondary game to the first user.

20. The gaming device of claim 15, wherein the outcome modifier adjusts the winning lottery amount, wherein the input of the first user comprises a skill-based input, wherein the rendered secondary game comprises a game of skill, wherein the skill-based input is generated from an outcome of the game of skill, wherein the outcome modifier comprises a plurality of outcome modifiers corresponding to a plurality of user levels, wherein the processor further provides a skill level of the first user to the lottery server, and wherein the outcome modifier is based on the skill level of the first user.

* * * * *